US008212753B2

(12) United States Patent
Tomizawa

(10) Patent No.: US 8,212,753 B2
(45) Date of Patent: Jul. 3, 2012

(54) LIQUID CRYSTAL DISPLAY

(75) Inventor: Kazunari Tomizawa, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 929 days.

(21) Appl. No.: 12/280,747

(22) PCT Filed: Nov. 24, 2006

(86) PCT No.: PCT/JP2006/323482

§ 371 (c)(1),
(2), (4) Date: Aug. 26, 2008

(87) PCT Pub. No.: WO2007/097080

PCT Pub. Date: Aug. 30, 2007

(65) Prior Publication Data

US 2009/0167657 A1 Jul. 2, 2009

(30) Foreign Application Priority Data

Feb. 27, 2006 (JP) ..... 2006-050801
Jul. 12, 2006 (JP) ..... 2006-191865

(51) Int. Cl.
*G09G 3/36* (2006.01)
*G09G 5/10* (2006.01)

(52) U.S. Cl. ..... 345/88; 345/89; 345/694

(58) Field of Classification Search ..... 345/87–90, 345/694–696

See application file for complete search history.

(56) References Cited

U.S. PATENT DOCUMENTS

| | | | | |
|---|---|---|---|---|
| 4,800,375 | A | 1/1989 | Silverstein et al. | |
| 5,552,800 | A * | 9/1996 | Uchikoga et al. | 345/89 |
| 2003/0146893 | A1 | 8/2003 | Sawabe | |
| 2004/0174389 | A1 * | 9/2004 | Ben-David et al. | 345/694 |
| 2004/0234163 | A1 | 11/2004 | Lee et al. | |
| 2005/0068281 | A1 | 3/2005 | Shin et al. | |
| 2005/0122294 | A1 | 6/2005 | Ben-David et al. | |
| 2005/0168423 | A1 | 8/2005 | Hirata et al. | |
| 2005/0231534 | A1 | 10/2005 | Lee | |
| 2006/0038953 | A1 | 2/2006 | Moriya | |
| 2006/0072058 | A1 | 4/2006 | Rho | |
| 2007/0268208 | A1 | 11/2007 | Okada et al. | |

FOREIGN PATENT DOCUMENTS

JP 09-251160 A 9/1997

(Continued)

OTHER PUBLICATIONS

Official Communication issued in International Patent Application No. PCT/JP2006/323482, mailed on Dec. 19, 2006.

(Continued)

*Primary Examiner* — Alexander Eisen
*Assistant Examiner* — Amit Chatly
(74) *Attorney, Agent, or Firm* — Keating & Bennett, LLP

(57) ABSTRACT

A liquid crystal display device includes a pixel defined by at least four sub-pixels. The sub-pixels include at least one sub-pixel belonging to a first group and at least one sub-pixel belonging to a second group, the sub-pixel of the second group being different from that of the first group. The luminances of the sub-pixels are set such that if the colors represented by the pixel change from black into white while being kept achromatic, the first group of sub-pixel starts to increase in luminance first, and the second group of sub-pixel starts to increase in luminance when the luminance of the first group of sub-pixel reaches a predetermined value.

22 Claims, 20 Drawing Sheets

FOREIGN PATENT DOCUMENTS

| | | | |
|---|---|---|---|
| JP | 2001-209047 | A | 8/2001 |
| JP | 2001-306023 | A | 11/2001 |
| JP | 2006-106062 | A | 4/2006 |
| JP | 2006-145982 | A | 6/2006 |
| JP | 2006-171049 | A | 6/2006 |
| WO | 03/088203 | A1 | 10/2003 |
| WO | 2005/111706 | A1 | 11/2005 |
| WO | 2006/109577 | A1 | 10/2006 |

OTHER PUBLICATIONS

Yang et al.: "Development of Six Primary-Color LCD," Society for Information Display 05 Digest; vol. 36; Book 2; pp. 1210-1213; May 25-27, 2005.

Chino et al.: "Development of Wide-Color-Gamut Mobile Displays With Four-Primary-Color LCDS," Society for Information Display 05 Digest; vol. 37; Book 2; pp. 1221-1224; Jun. 7-9, 2006.

Ben-Chorin: "Improving LCD TV Color Using Multi-Primary Technology," FPD International 2005 Forum; 60 pgs; Oct. 19, 2005.

Tomizawa et al.: "Display," U.S. Appl. No. 12/066,866, filed Mar. 14, 2008.

Official Communication issued in corresponding European Patent Application No. 06833286.5, mailed on Jul. 27, 2010.

English translation of the official communication issued in counterpart International Application No. PCT/JP2006/323482, mailed on Sep. 12, 2008.

* cited by examiner

INPUT
OUTPUT

Max
Y=0.1
$R_i$ $G_i$ $B_i$
CONVERT
Max
Y=0.1
R G B Ye C M

Max
Y=0.3
$R_i$ $G_i$ $B_i$
CONVERT
Max
Y=0.3
R G B Ye C M

Max
Y=1.0
$R_i$ $G_i$ $B_i$
CONVERT
Max
Y=1.0
R G B Ye C M

LIQUID CRYSTAL DISPLAY

BACKGROUND OF THE INVENTION

1. Field of the Invention

The present invention generally relates to a liquid crystal display device, and more particularly relates to a liquid crystal display device for conducting a display operation using four or more primary colors.

2. Description of the Related Art

A color liquid crystal display device such as a color TV monitor or a color display monitor represents colors usually by adding together the three primary colors of red (R), green (G) and blue (b). Each pixel in a color liquid crystal display device usually has red, green and blue sub-pixels for these three primary colors of RGB. By changing the luminances of these red, green and blue sub-pixels, a variety of colors can be represented.

The luminance of each of the sub-pixels varies within the range from the one corresponding to the lowest gray scale level thereof (e.g., gray scale level 0) through the one corresponding to the highest gray scale level thereof (e.g., gray scale level 255). In the following description, the luminance of a sub-pixel corresponding to the lowest gray scale level will be represented herein by "0.0" and the luminance of a sub-pixel corresponding to the highest gray scale level by "1.0" for the sake of convenience. Therefore, the luminance of each of the sub-pixels is controlled within the range of 0.0 to 1.0.

If the luminance of each of all these sub-pixels, namely, the red, green and blue sub-pixels, is 0.0, the color represented by the pixel is black. Conversely, if the luminance of each of all these sub-pixels is 1.0, the color represented by the pixel is white. Recently, TV sets often allow the user to control the color temperature. In that case, the color temperature is controlled by finely adjusting the luminances of the respective sub-pixels. For that reason, the luminance of each sub-pixel after the color temperature has been controlled to a desired value is supposed herein to be 1.0.

Hereinafter, it will be described with reference to FIG. 26 how the luminances of respective sub-pixels vary in a situation where a conventional LCD changes the colors represented by a pixel from black into white while keeping those colors achromatic. As used herein, the "achromatic" color is a color without a hue such as black, gray and white.

FIG. 26 shows how the colors represented by a pixel change in a conventional LCD as the luminances of respective sub-pixels vary. As shown in portions (a) and (b) of FIG. 26, if the color represented by the pixel is black, the luminance of each of the red, green and blue pixels is all 0.0.

First, the luminances of the red, green and blue sub-pixels are increased at the same rate. As the luminances of the respective sub-pixels are increased, the lightness of the pixel increases and the colors represented by the pixel change from black into gray. In that case, if the luminances of the red, green and blue sub-pixels are increased at the same rate, then the lightness can be increased with the same chromaticity maintained, i.e., with the color represented by the pixel kept achromatic and hueless. If the luminances of the red, green and blue sub-pixels continue to be increased, the color represented by the pixel will change from dark gray into light gray. And when the luminance of each of the red, green and blue sub-pixels finally reaches 1.0, the color represented by the pixel will become white. Conversely, if the luminances of the red, green and blue sub-pixels are decreased from 1.0 to 0.0 at the same rate, then the colors represented by the pixel change from white into black while being achromatic. Thus, a conventional LCD using the three primary colors varies the luminances of the respective sub-pixels at the same rate, thereby changing the lightness of the achromatic colors.

It is known that LCDs have various modes of operation. However, as a TN mode LCD has problems in its display performance (especially in terms of its viewing angle characteristic), various LCDs with improved viewing angle characteristics have been developed recently. Examples of those LCDs with improved viewing angle characteristics include inplane switching (IPS) mode LCDs, multi-domain vertical aligned (MVA) mode LCDs, and axially symmetric aligned microcell (ASM) mode LCDs. Those LCDs operating in new modes that achieve wide viewing angles would not cause problems such as a significant decrease in display contrast ratio when the image on the screen is viewed obliquely and the inversion of display gray scale.

Meanwhile, an LCD that adds together four or more primary colors, not the three primary colors in the conventional LCDs mentioned above, was also proposed. By performing a multi-primary-color display operation with an additional primary color(s) with respect to the three primary colors of RGB, this LCD expands the color representation range (see Patent Document No. 1, for example).

Patent Document No. 1: PCT International Application Japanese National Phase Publication No. 2004-529396

The present inventors carried out extensive research on a method for getting a multi-primary-color display operation done in a wide color reproduction range by a liquid crystal display device with improved viewing angle characteristic. As a result, the present inventors found the following problems.

Specifically, a so-called "whitening phenomenon" sometimes occurs in a liquid crystal display device that operates in a new mode to achieve a wide viewing angle. As used herein, the "whitening phenomenon" refers to a phenomenon that when the image on the monitor screen is viewed obliquely, portions that should have intermediate gray scale levels look excessively whitish. This whitening phenomenon occurs because the γ characteristic in the oblique viewing direction is different from the one in the frontal viewing direction. That is to say, in these two directions, the γ characteristics have different degrees of viewing angle dependence. As used herein, the γ characteristic refers to the gray scale level dependence of a display luminance. Since the γ characteristics are different in the frontal and oblique viewing directions, the change of the gray scale level (or luminance) varies differently according to the viewing direction. That is why this is a serious problem particularly when a still picture such as a photo is displayed or when a TV program received is presented. If a multi-primary-color display operation were conducted just by adding additional color(s) to the three primary colors used by such an LCD that causes significant whitening phenomenon, the whitening phenomenon would still be quite noticeable and the display quality would never be improved.

SUMMARY OF THE INVENTION

In order to overcome the problems described above, preferred embodiments of the present invention provide a liquid crystal display device that can conduct a display operation in a wide color reproduction range with the whitening phenomenon suppressed.

A liquid crystal display device according to a preferred embodiment of the present invention includes a pixel defined by at least four sub-pixels. The sub-pixels include at least one sub-pixel belonging to a first group and at least one sub-pixel belonging to a second group, and the sub-pixel of the second group is different from that of the first group. The luminances of the sub-pixels are set such that if the colors represented by the pixel change from black into white while being kept achromatic, the first group of sub-pixel starts to increase in luminance first, and the second group of sub-pixel starts to increase in luminance when the luminance of the first group of sub-pixel reaches a predetermined value.

In one preferred embodiment, the area of the sub-pixel in the first group is equal to that of the sub-pixel in the second group.

In another preferred embodiment, the area of the sub-pixel in the first group is smaller than that of the sub-pixel in the second group.

In still another preferred embodiment, achromatic colors are represented by each of the sub-pixel belonging to the first group and the sub-pixel the second group.

In yet another preferred embodiment, the chromaticity of the pixel in a situation where the luminance of the first group of sub-pixel is increased with that of the second group of sub-pixel kept equal to a value associated with the lowest gray scale level is equal to that of the pixel in a situation where each of all the sub-pixels has a luminance associated with the highest gray scale level.

In yet another preferred embodiment, the luminance of the pixel in a situation where the luminance of the first group of sub-pixel is increased to a value associated with the highest gray scale level with that of the second group of sub-pixel kept equal to a value associated with the lowest gray scale level is lower than that of the pixel in a situation where the luminance of the second group of sub-pixel is increased to the value associated with the highest gray scale level with that of the first group of sub-pixel kept equal to the value associated with the lowest gray scale level.

In yet another preferred embodiment, the first group of sub-pixel includes multiple sub-pixels. In every sub-pixel in the first group, the ratio of the predetermined luminance to a luminance associated with the highest gray scale level is the same.

In yet another preferred embodiment, the predetermined luminance is a luminance of the first group of sub-pixel that is associated with the highest gray scale level.

In yet another preferred embodiment, the predetermined luminance is lower than a luminance of the first group of sub-pixel that is associated with the highest gray scale level.

In yet another preferred embodiment, the first group of sub-pixel includes multiple sub-pixels. The luminances of the sub-pixels are set such that in a situation where the colors represented by the pixel change from black into white while being kept achromatic, when the luminance of the sub-pixels in the first group reaches the predetermined value, the second group of sub-pixel starts to increase in luminance and at least one of the sub-pixels in the first group continues to increase in luminance.

In this particular preferred embodiment, the predetermined luminance preferably is at least 0.3 times as large as, but still not more than, the luminance associated with the highest gray scale level.

In a specific particular preferred embodiment, the predetermined luminance preferably is 0.9 times as large as the luminance associated with the highest gray scale level.

In another preferred embodiment, the first group of sub-pixel includes multiple sub-pixels, and the ratio of the predetermined luminance to the luminance associated with the highest gray scale level is different from each other in each of the sub-pixels in the first group.

In still another preferred embodiment, the first group of sub-pixel includes red, green and blue sub-pixels.

In this particular preferred embodiment, the second group of sub-pixel includes yellow, cyan and magenta sub-pixels.

In an alternative preferred embodiment, the second group of sub-pixel includes yellow and cyan sub-pixels and another red sub-pixel, which is different from the red sub-pixel.

In another preferred embodiment, the second group of sub-pixel includes a white sub-pixel.

In still another preferred embodiment, the second group of sub-pixel includes yellow and cyan sub-pixels.

In yet another preferred embodiment, the first group of sub-pixel includes yellow, cyan and magenta sub-pixels, and the second group of sub-pixel includes red, green and blue sub-pixels.

Another liquid crystal display device according to a preferred embodiment of the present invention includes a pixel that represents a color by using four or more primary colors in an arbitrary combination at an arbitrary luminance. The primary colors include at least one primary color belonging to a first group and at least one primary color belonging to a second group, the primary color of the second group being different from that of the first group. The luminances of the primary colors are set such that if the colors represented by the pixel change from black into white while being kept achromatic, the first group of primary color starts to increase in luminance first, and the second group of primary color starts to increase in luminance when the luminance of the first group of primary color reaches a predetermined value.

Another liquid crystal display device according to a preferred embodiment of the present invention includes a pixel defined by at least four sub-pixels. The sub-pixels include at least one sub-pixel belonging to a first group and at least one sub-pixel belonging to a second group, the sub-pixel of the second group being different from that of the first group. The sub-pixels represent a color including a chromatic component and an achromatic component. The luminances of the sub-pixels, which are associated with the achromatic component, are set such that if the achromatic component change from a minimum value into a maximum value, the first group of sub-pixels starts to increase in luminance first, and the second group of sub-pixels starts to increase in luminance when the luminance of the first group of sub-pixels reaches a predetermined value.

A signal converter according to a preferred embodiment of the present invention generates a multi-primary-color signal, representing the luminances of multiple primary colors, based on a video signal for use in a multi-primary-color display panel that conducts a display operation in four or more primary colors, including at least one primary color belonging to a first group and at least one primary color belonging to a second group, the primary color of the second group being different from that of the first group. The signal converter preferably includes: a color component separating section for separating a color specified by the video signal into an achromatic component and a chromatic component; an achromatic component converting section for converting the achromatic component of the video signal into color components of the multiple primary colors; a chromatic component converting section for converting the chromatic component of the video signal into color components of the multiple primary colors; and a synthesizing section for synthesizing together the color components of the multiple primary colors that have been converted by the achromatic and chromatic component converting sections, thereby generating the multi-primary-color signal. If the achromatic component change from a minimum value into a maximum value, the achromatic component converting section start to increase the luminance of the first group of primary colors first, and starts to increase the luminance of the second group of primary colors when the luminance of the first group of primary colors reaches a predetermined value.

Preferred embodiments of the present invention provide a liquid crystal display device that can not only conduct a display operation in a wide color reproduction range but also suppress the whitening phenomenon.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 3A-3E illustrates how respective sub-pixels change their luminances in a situation where the liquid crystal display device of the first preferred embodiment changes the colors represented by a pixel from black into white while keeping them achromatic, wherein FIGS. 3A-3E show how the red, green, blue, yellow, cyan and magenta sub-pixels, respectively, change their luminances.

Figure 5:
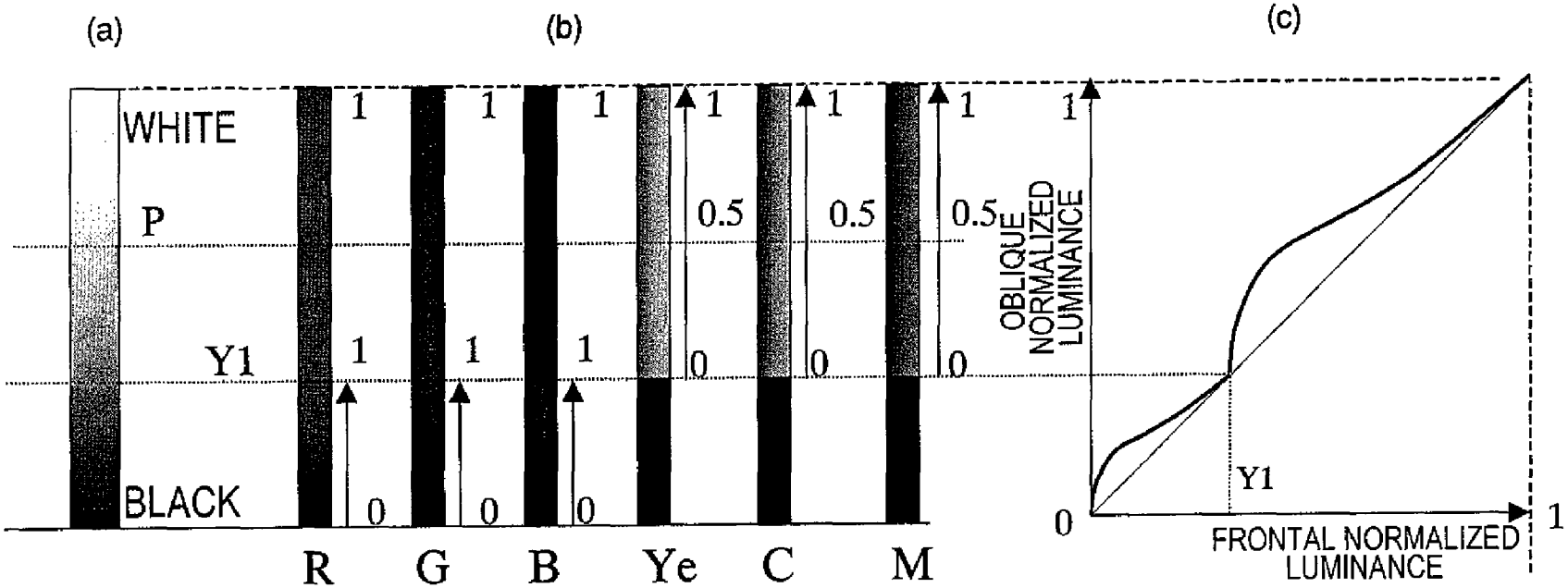

Portion (a) of FIG. 5 illustrates how the colors represented by a pixel change in the liquid crystal display device of the first preferred embodiment, portion (b) of FIG. 5 illustrates how the luminances of the sub-pixels vary, and portion (c) of FIG. 5 is a graph showing a relation between oblique and frontal normalized luminances.

Figure 6:
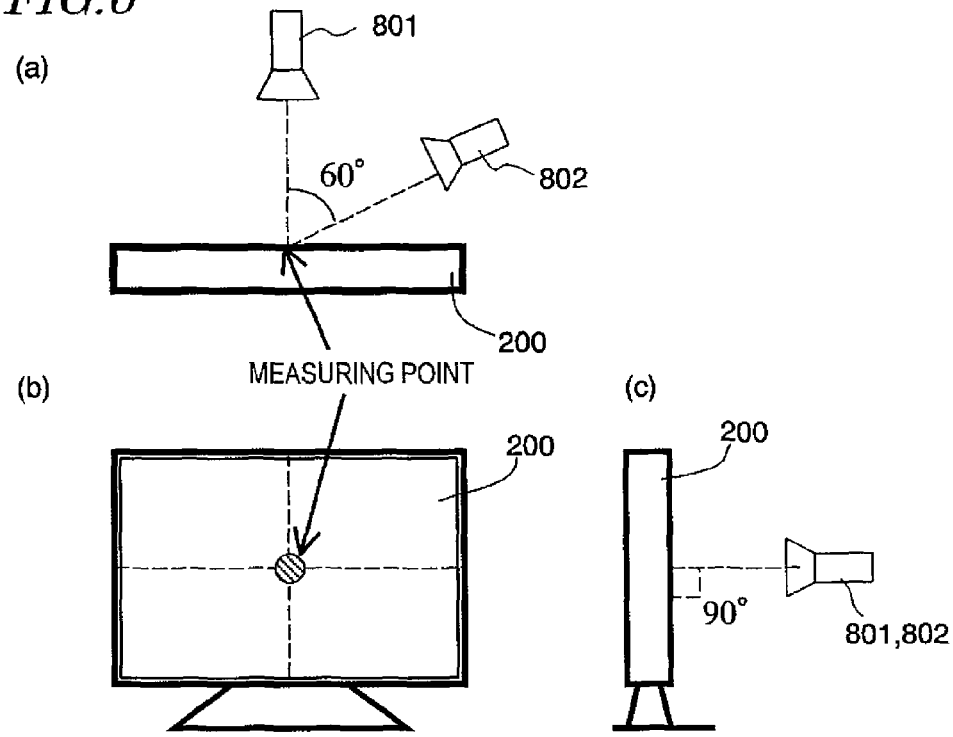

Portions (a) through (c) of FIG. 6 are respectively a top view, a front view and a side view of a multi-primary-color display panel to show what the frontal and oblique normalized luminances are.

Figure 7:
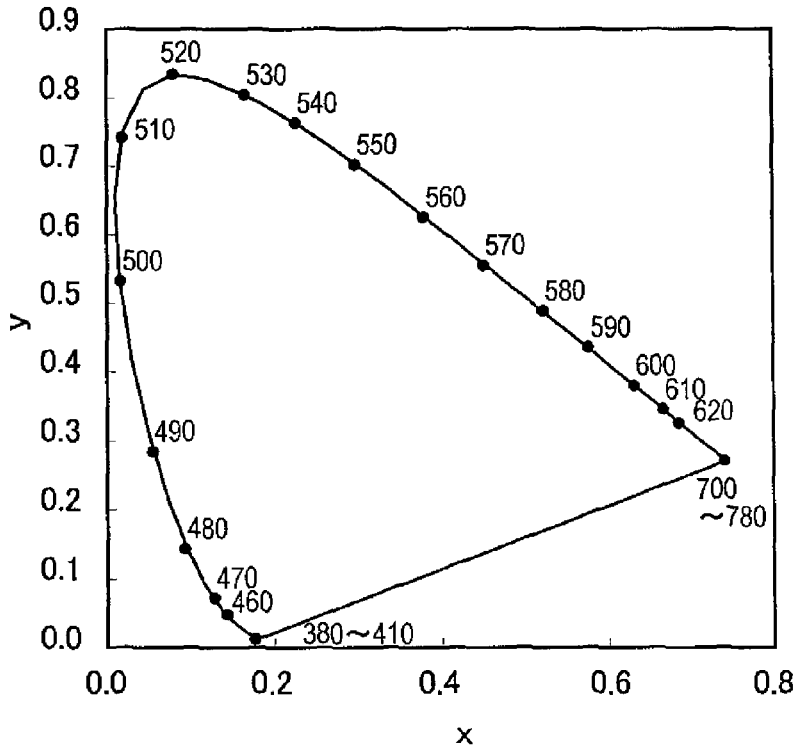

FIG. 7 is a chromaticity diagram according to the XYZ color system.

Figure 8:
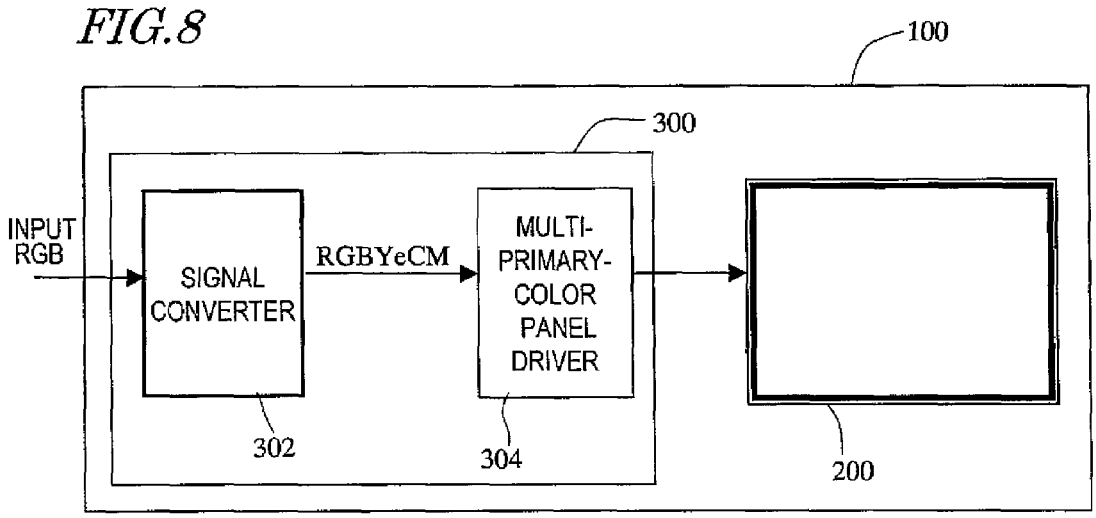

FIG. 8 is a schematic representation illustrating a configuration for the liquid crystal display device as the first preferred embodiment.

Figure 9:
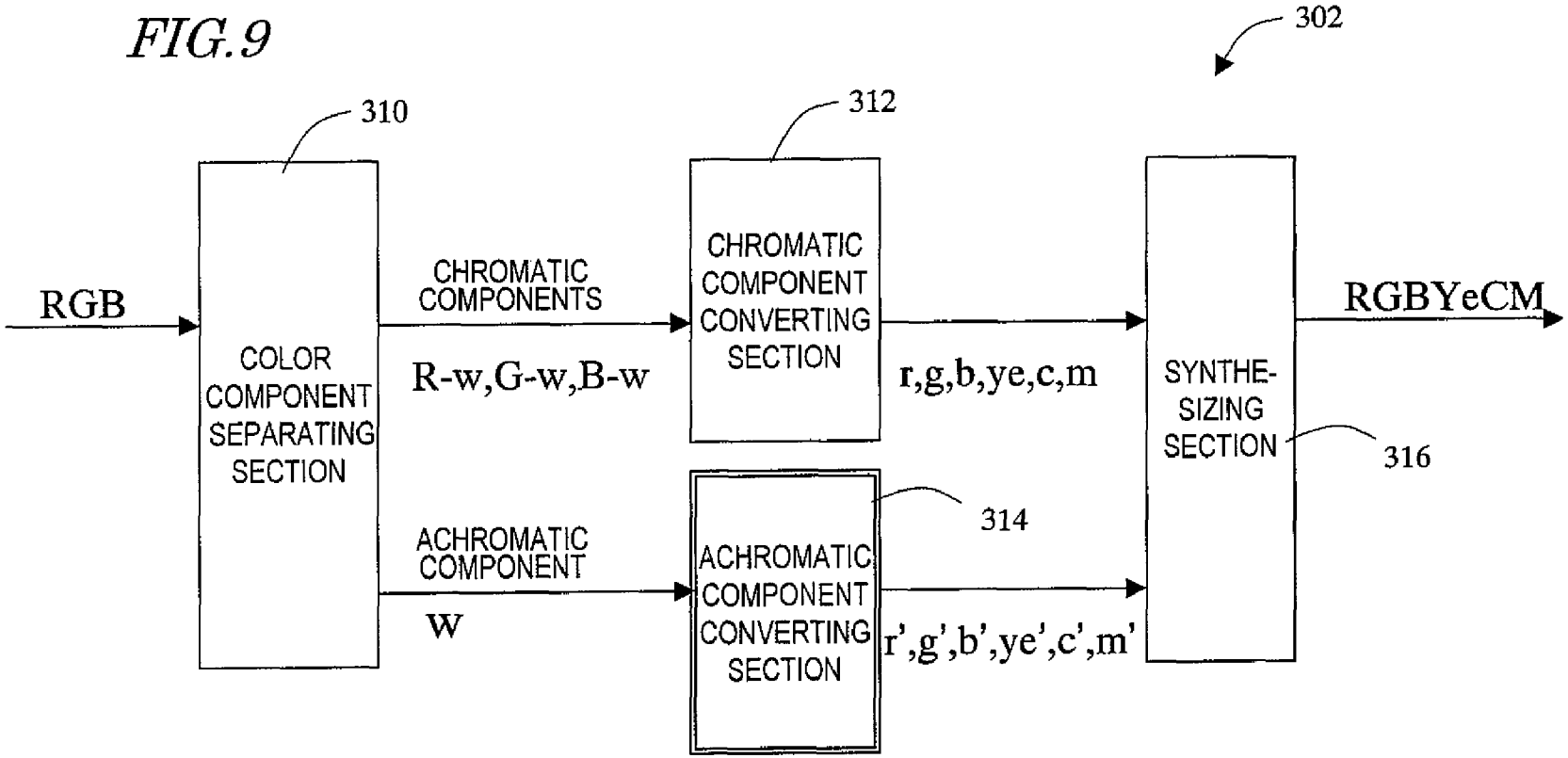

FIG. 9 is a block diagram illustrating a configuration for the signal converter of the liquid crystal display device of the first preferred embodiment.

FIGS. 10A-10D are schematic representations illustrating how the liquid crystal display device of the first preferred embodiment extracts achromatic and chromatic components from the color specified by an input signal.

Figures 11A, 11B, 11C:
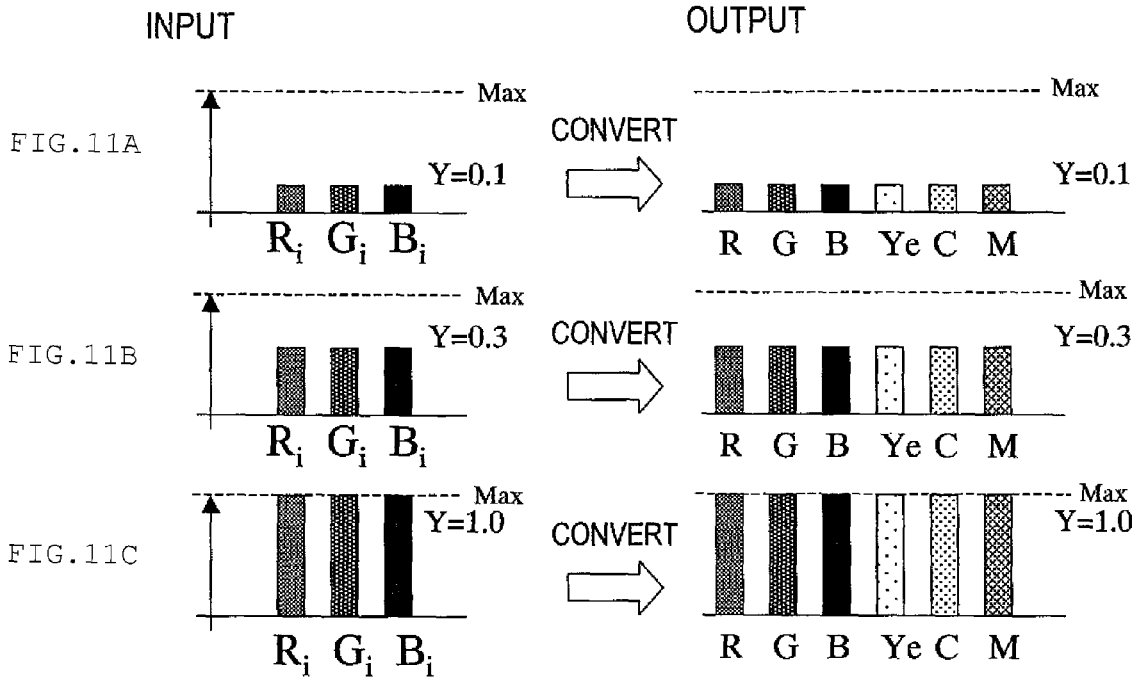

FIGS. 11A-11C show relations between the luminance represented by the input signal and the one represented by the output signal in the liquid crystal display device as the comparative example.

Figure 12A:
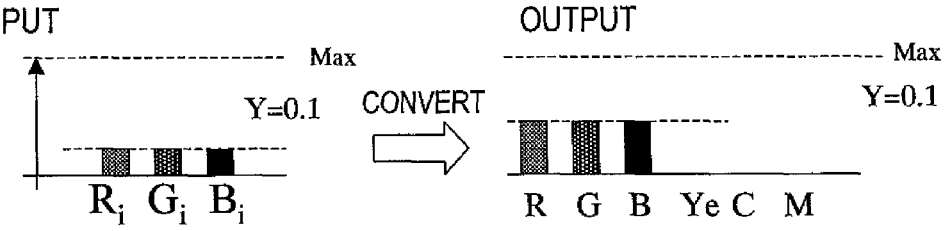
Figure 12B:
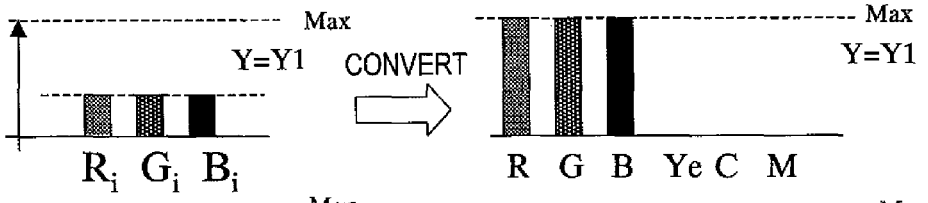
Figure 12C:
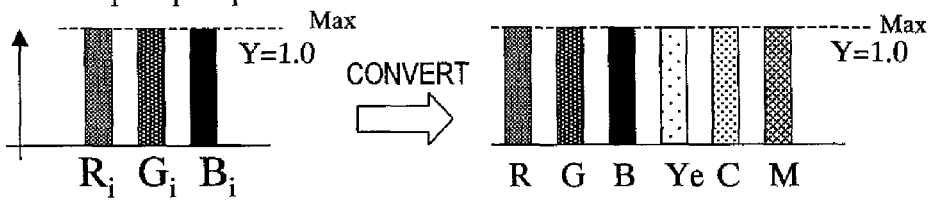
Figure 12D:
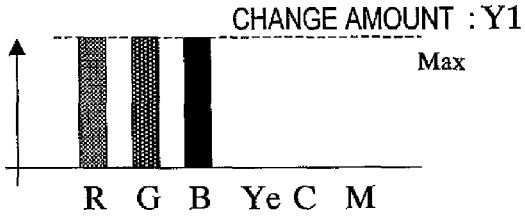
Figure 12E:
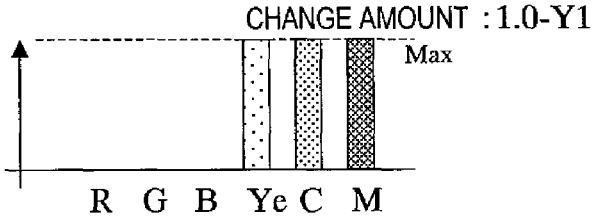

FIGS. 12A-12C show relations between the luminance represented by the input signal and the one represented by the output signal in the liquid crystal display device of the first preferred embodiment and FIGS. 12D and 12E show the luminances of the respective sub-pixels when the luminance of the pixel falls within first and second ranges, respectively.

Figure 13:
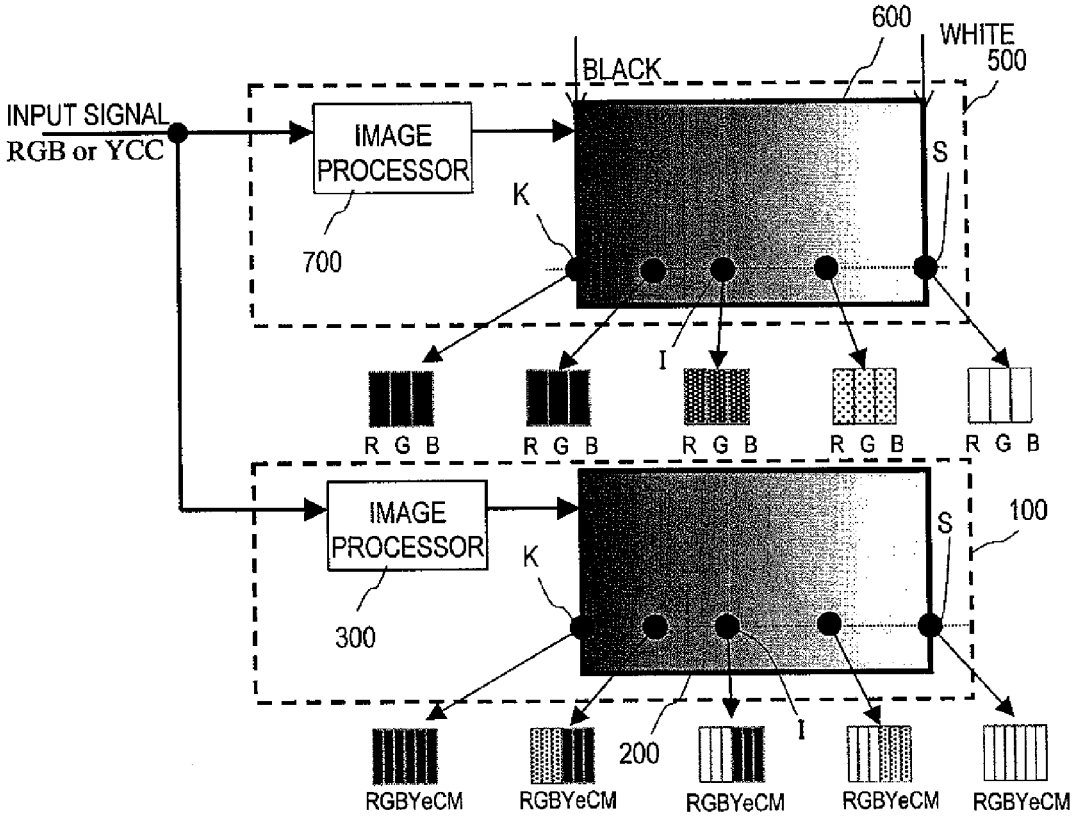

FIG. 13 is a schematic representation illustrating how the sub-pixels change their luminances in the liquid crystal display device of the first preferred embodiment and in a three-primary-color liquid crystal display device.

Figure 14:
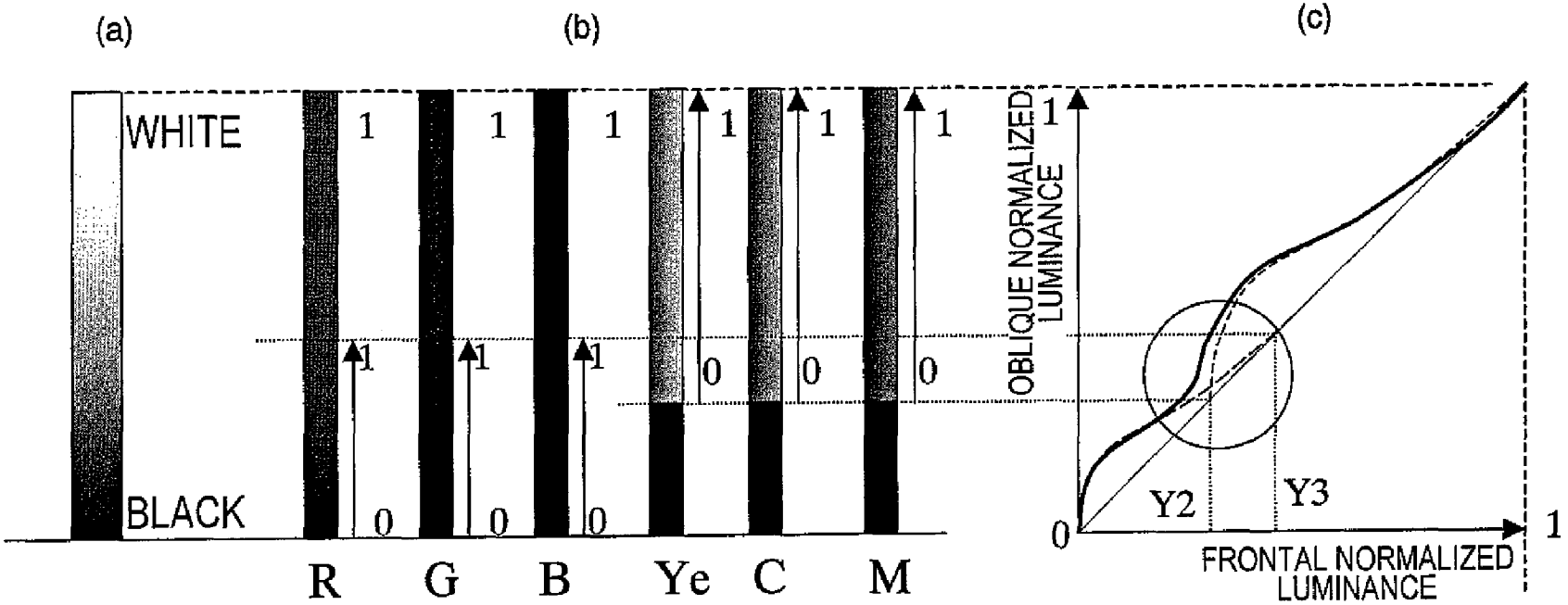

Portion (a) of FIG. 14 illustrates how the colors represented by a pixel change in a liquid crystal display device according to a second preferred embodiment of the present invention, portion (b) of FIG. 14 illustrates how the luminances of the sub-pixels vary, and portion (c) of FIG. 14 is a graph showing a relation between oblique and frontal normalized luminances.

Figure 15A:
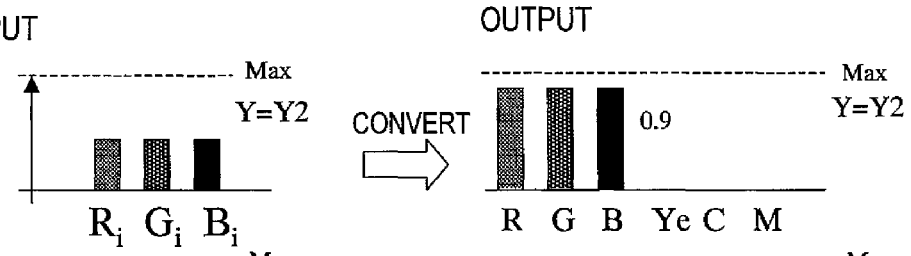
Figure 15B:
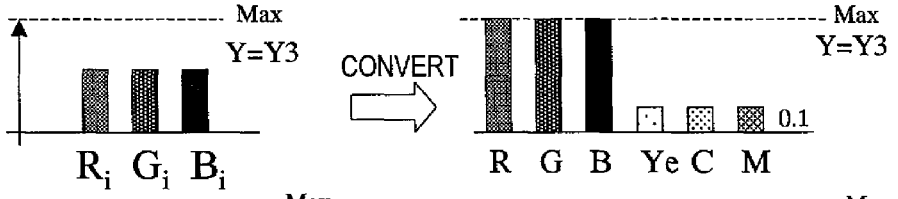
Figure 15C:
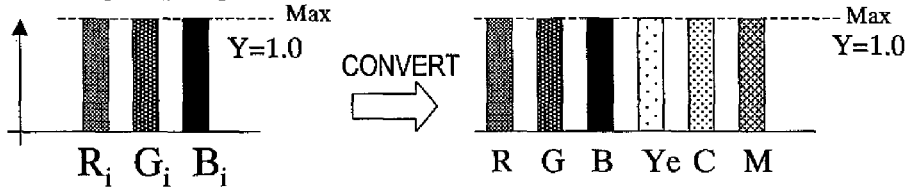
Figure 15D:
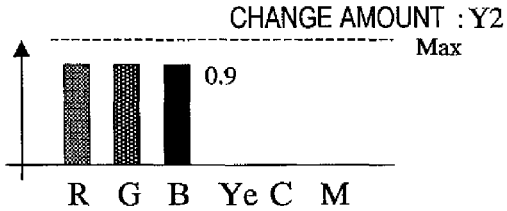
Figure 15E:
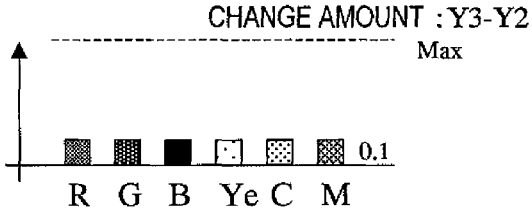
Figure 15F:
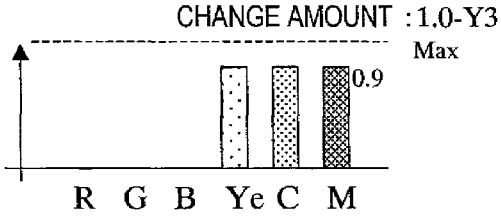

FIGS. 15A-15C show relations between the luminance represented by the input signal and the one represented by the output signal in the liquid crystal display device of the second preferred embodiment and FIGS. 15D-15F show the luminances of the respective sub-pixels when the luminance of the pixel falls within first, second and third ranges, respectively.

Figure 16A:
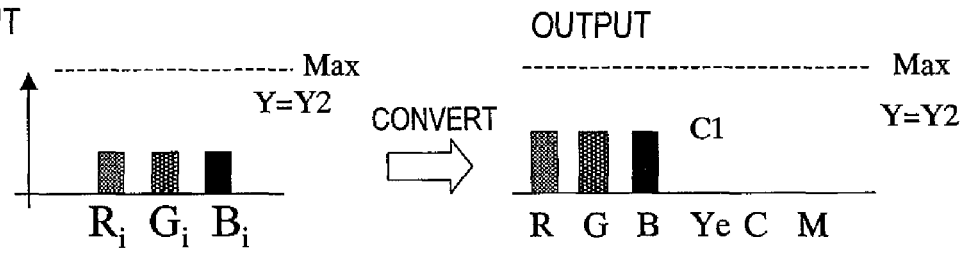
Figure 16B:
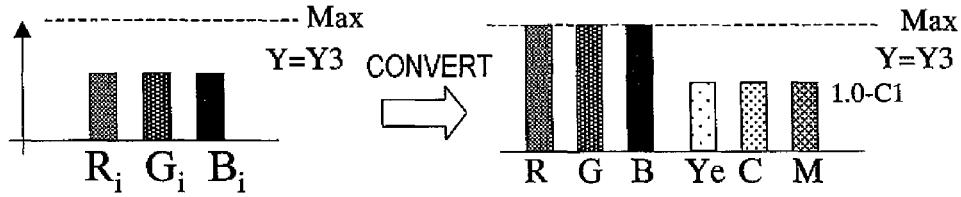
Figure 16C:
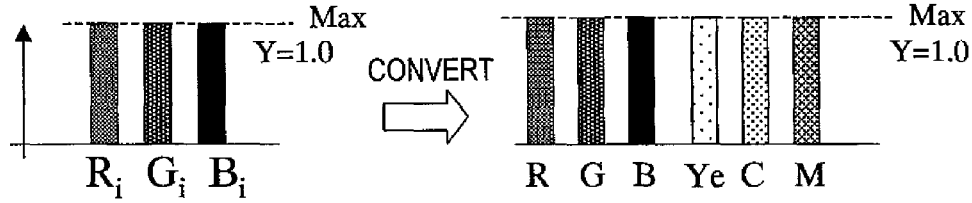
Figure 16D:
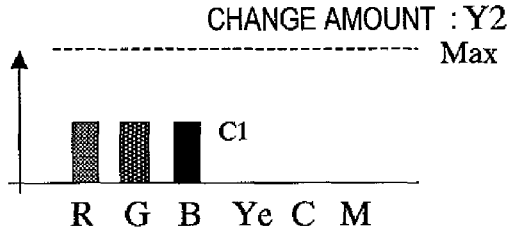
Figure 16E:
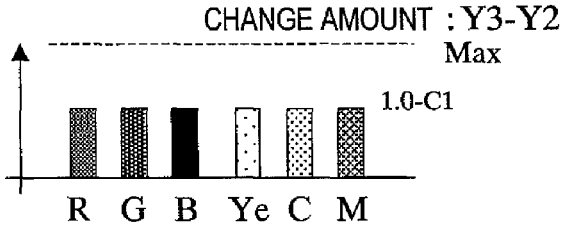
Figure 16F:
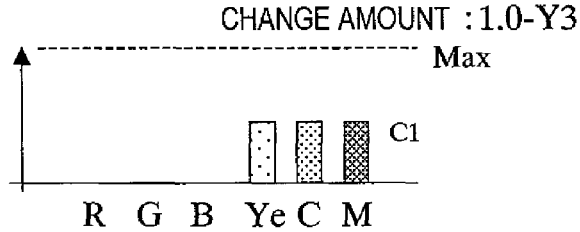

FIGS. 16A-16C show relations between the luminance represented by the input signal and the one represented by the output signal in the liquid crystal display device of the second preferred embodiment and FIGS. 16D-16F show the luminances of the respective sub-pixels when the luminance of the pixel falls within first, second and third ranges, respectively.

Figure 17A:
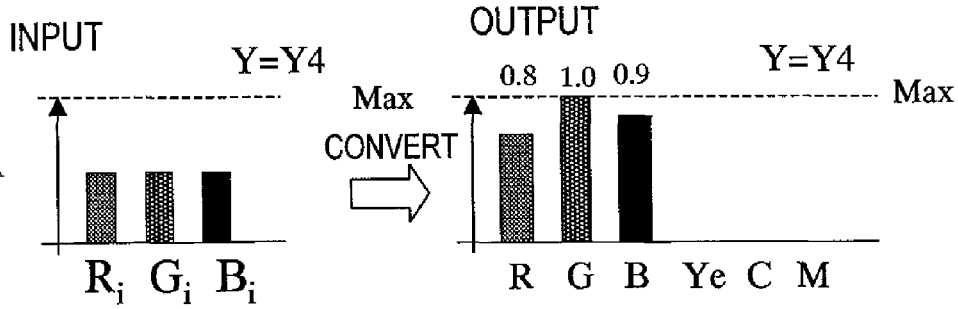
Figure 17B:
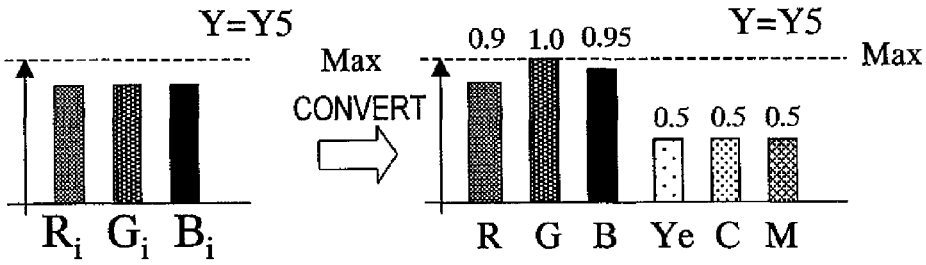
Figure 17C:
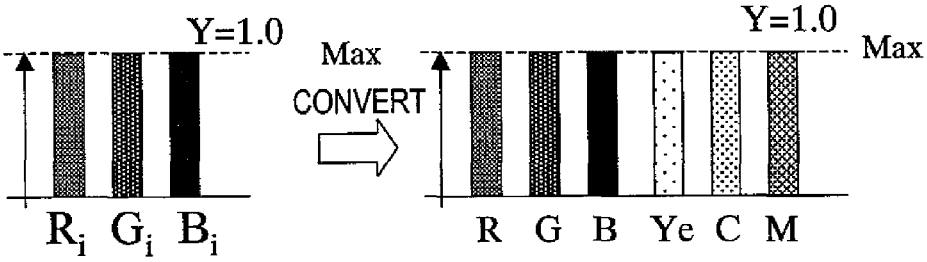
Figure 17D:
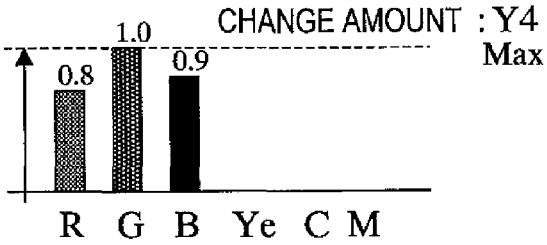
Figure 17E:
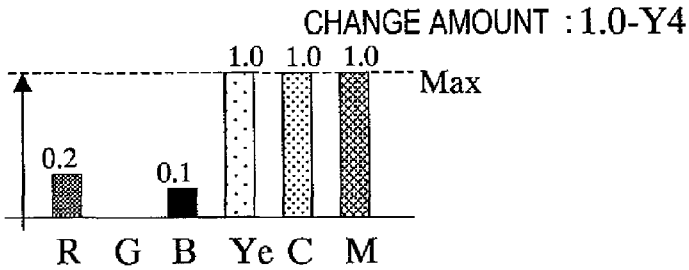

FIGS. 17A-17C show relations between the luminance represented by the input signal and the one represented by the output signal in a liquid crystal display device as a third preferred embodiment of the present invention and FIGS. 17D and 17E show the luminances of the respective sub-pixels when the luminance of the pixel falls within first and second ranges, respectively.

Figure 18:
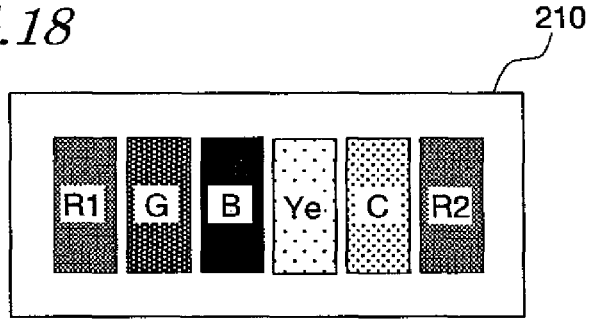

FIG. 18 is a plan view illustrating each pixel of a liquid crystal display device as a fourth preferred embodiment of the present invention.

Figure 19:
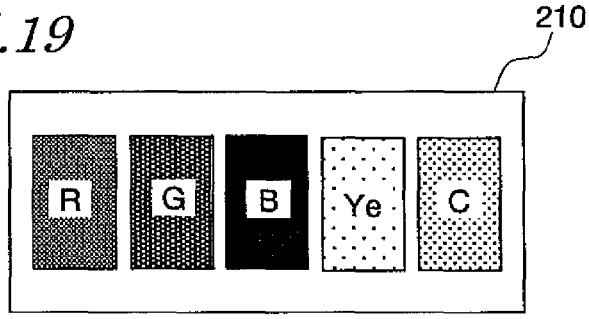

FIG. 19 is a plan view illustrating each pixel of a liquid crystal display device as a fifth preferred embodiment of the present invention.

Figure 20:
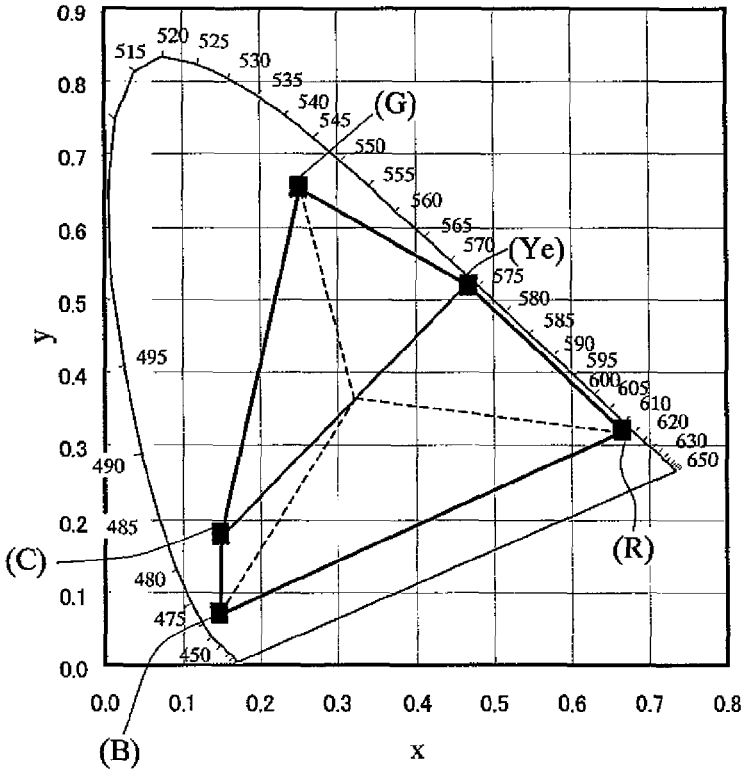

FIG. 20 is an XYZ color system chromaticity diagram showing the chromaticity values of respective sub-pixels in the liquid crystal display device of the fifth preferred embodiment.

Figure 21A:
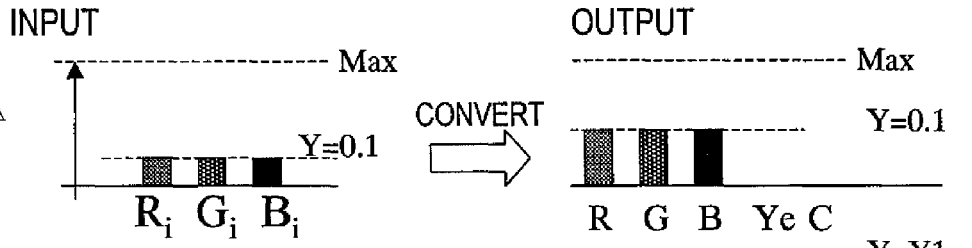
Figure 21B:
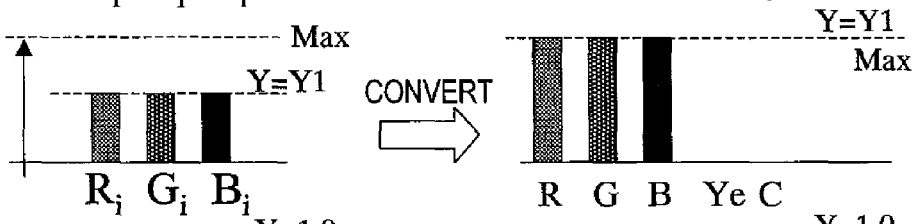
Figure 21C:
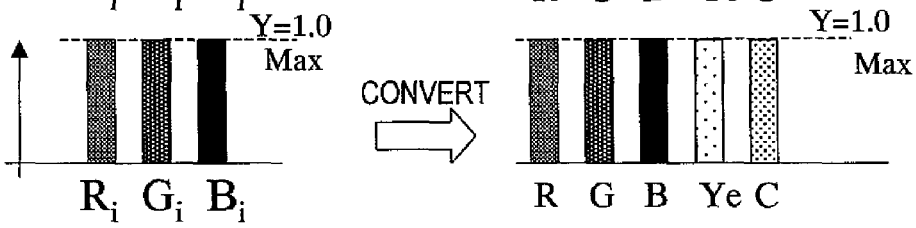
Figure 21D:
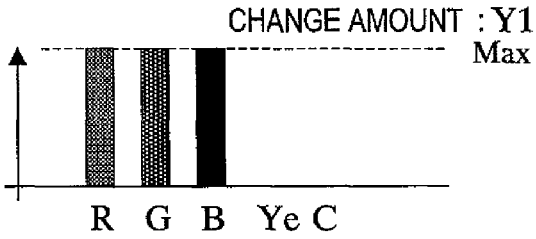
Figure 21E:
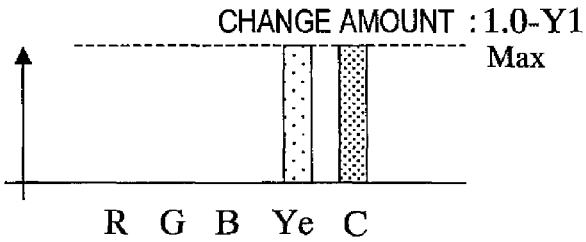

FIGS. 21A-21C show relations between the luminance represented by the input signal and the one represented by the output signal in the liquid crystal display device of the fifth preferred embodiment and FIGS. 21D and 21E show the luminances of the respective sub-pixels when the luminance of the pixel falls within first and second ranges, respectively.

Figure 22:
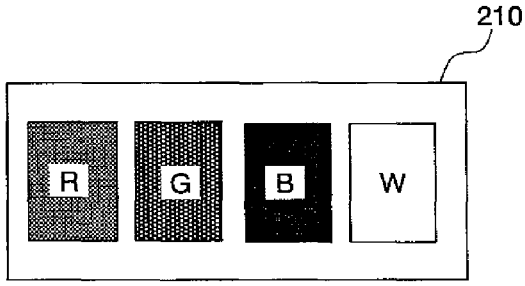

FIG. 22 is a plan view illustrating each pixel of a liquid crystal display device as a sixth preferred embodiment of the present invention.

Figure 23A:
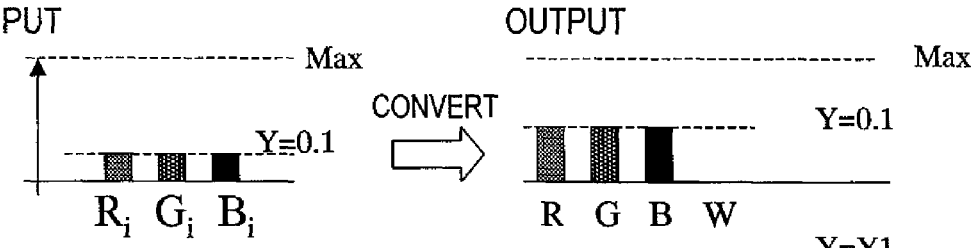
Figure 23B:
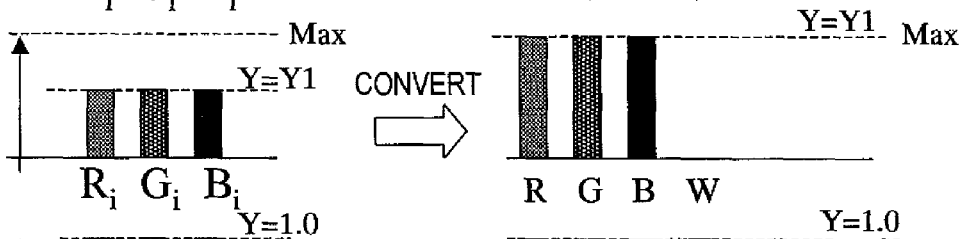
Figure 23C:
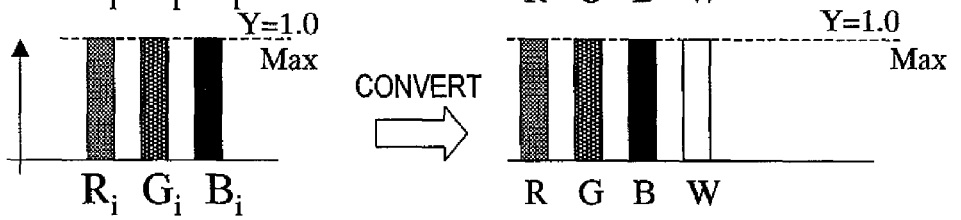
Figure 23D:
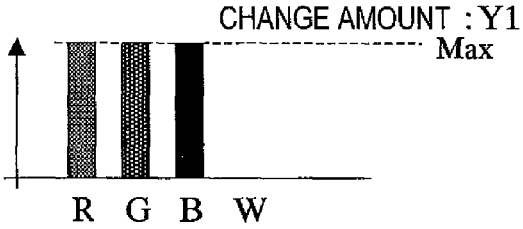
Figure 23E:
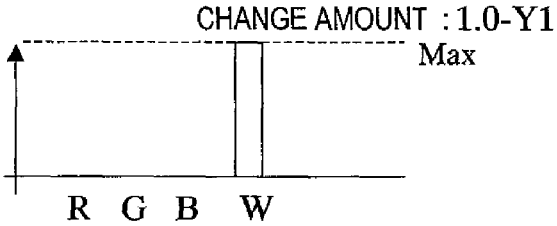

FIGS. 23A-23C show relations between the luminance represented by the input signal and the one represented by the output signal in the liquid crystal display device of the sixth preferred embodiment and FIGS. 23D and 23E show the luminances of the respective sub-pixels when the luminance of the pixel falls within first and second ranges, respectively.

Figure 24:
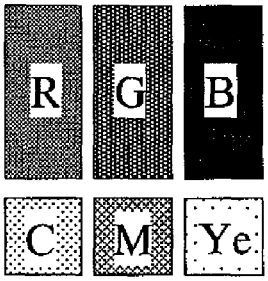

FIG. 24 is a plan view illustrating each pixel of a liquid crystal display device as a seventh preferred embodiment of the present invention.

Figure 25:
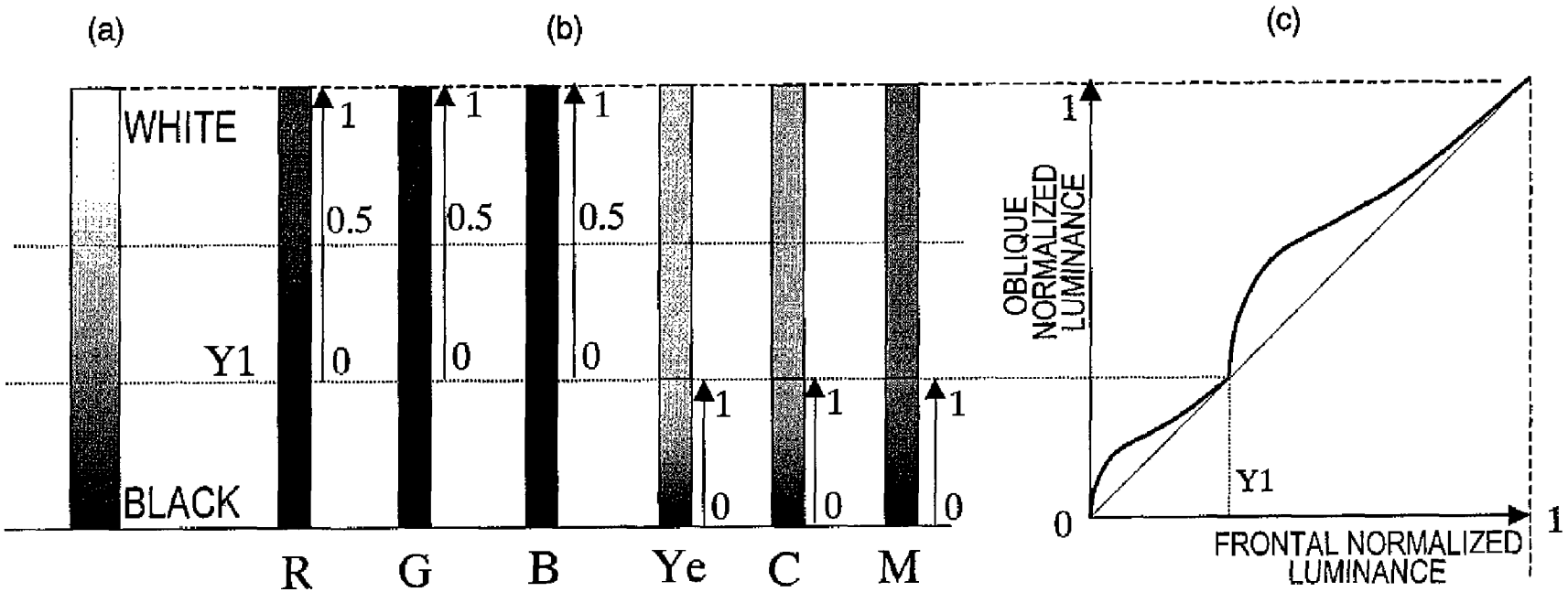

Portion (a) of FIG. 25 illustrates how the colors represented by a pixel change in the liquid crystal display device of the seventh preferred embodiment, portion (b) of FIG. 25 illustrates how the luminances of the sub-pixels vary, and portion (c) of FIG. 25 is a graph showing a relation between oblique and frontal normalized luminances.

Figure 26:
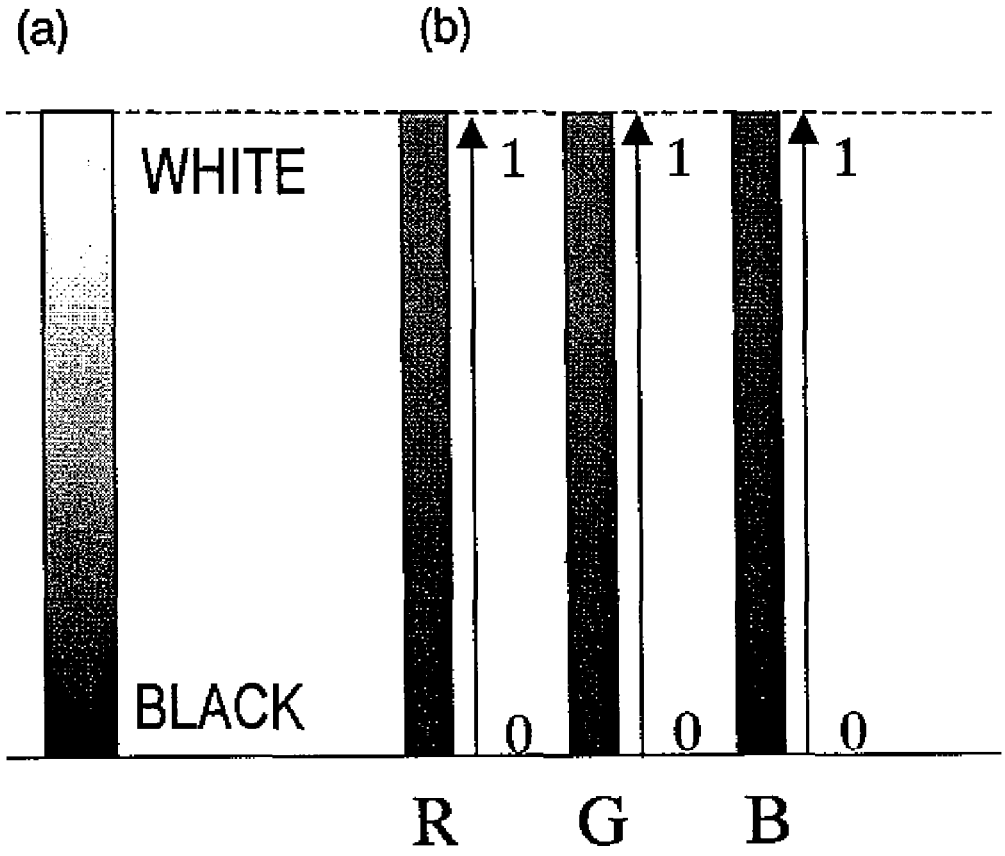
FIG.26 PRIOR ART

FIG. 26 illustrates how the colors represented by a pixel change as the luminances of respective sub-pixels vary in a conventional liquid crystal display device, wherein portion (a) of FIG. 26 illustrates how the colors represented by a pixel change and portion (b) of FIG. 26 illustrates how the luminances of the sub-pixels vary.

DETAILED DESCRIPTION OF THE PREFERRED EMBODIMENTS

Preferred Embodiment 1

Hereinafter, a first preferred embodiment of a liquid crystal display device according to the present invention will be described with reference to the accompanying drawings.

Figure 1:
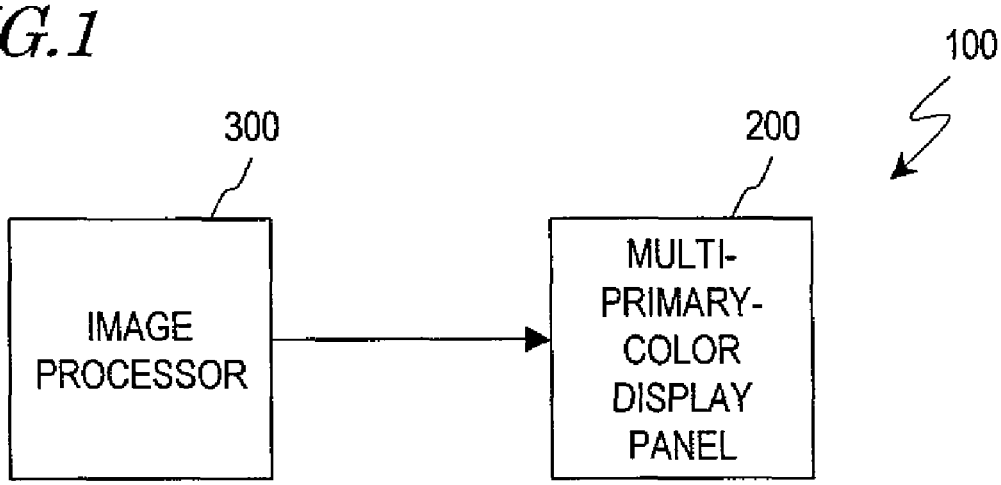
FIG. 1 schematically illustrates the configuration of a liquid crystal display device according to a first preferred embodiment of the present invention.

FIG. 1 is a block diagram schematically illustrating the configuration of a liquid crystal display device 100 according to this preferred embodiment. The liquid crystal display device 100 includes a multi-primary-color display panel 200 and an image processor 300 for generating a signal to be supplied to the multi-primary-color display panel 200. The multi-primary-color display panel 200 may be an MVA mode LCD panel, for example, and includes a plurality of pixels.

Figure 2:
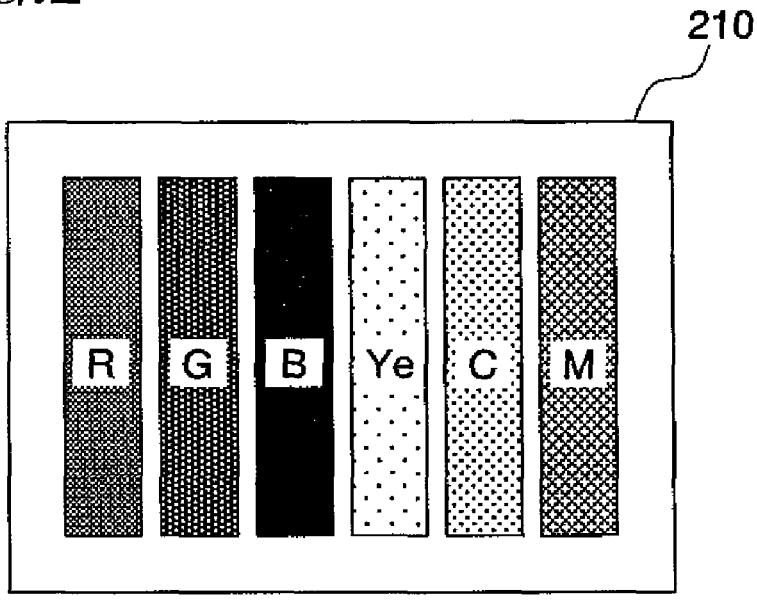
FIG. 2 is a schematic representation illustrating a single pixel in the liquid crystal display device of the first preferred embodiment.

As shown in FIG. 2, each pixel 210 in the multi-primary-color display panel 200 includes a red sub-pixel (R), a green sub-pixel (G), a blue sub-pixel (B), a yellow sub-pixel (Ye), a cyan sub-pixel (C) and a magenta sub-pixel (M). That is to say, in the liquid crystal display device 100 of this preferred embodiment, each pixel 210 includes not only the red, green and blue sub-pixels (R), (G) and (B) but also three other sub-pixels of yellow (Ye), cyan (C) and magenta (M). These six sub-pixels can be provided for a single pixel 210 by defining six different sub-pixel regions in each pixel region on a color filter layer (not shown) for the multi-primary-color display panel 200 and forming color filters in mutually different colors in those sub-pixel regions.

Red, green and blue are called the "three primary colors of light", while yellow, cyan and magenta are called the "three primary colors of colors". The red, green and blue sub-pixels can represent an achromatic color and the yellow, cyan and magenta sub-pixels can also represent an achromatic color. Those sub-pixels are arranged in stripes as shown in FIG. 2 and their areas are equal to each other.

The luminance of each of the sub-pixels varies within the range from the one corresponding to the lowest gray scale level thereof (e.g., gray scale level 0) through the one corresponding to the highest gray scale level thereof (e.g., gray scale level 255). In the following description, the luminance of a sub-pixel corresponding to the lowest gray scale level will be referred to herein as the "minimum luminance" and represented herein by the value "0.0" and the luminance of a sub-pixel corresponding to the highest gray scale level will be referred to herein as the "maximum luminance" and represented herein by the value "1.0" for the sake of convenience. The higher the gray scale level of each sub-pixel, the higher luminance thereof. The number of gray scale level of every sub-pixel is set to be equal to each other. If multiple different sub-pixels have the same gray scale level, their luminance values with respect to the maximum luminance (or luminance levels) are equal to each other.

In the liquid crystal display device 100 of this preferred embodiment, the chromaticity of a pixel in a situation where the luminances of the red, green and blue sub-pixels are increased at the same rate with the luminances of the yellow, cyan and magenta sub-pixels kept minimum is equal to that of the pixel in a situation where the luminances of the yellow, cyan and magenta sub-pixels are increased at the same rate with the luminances of the red, green and blue sub-pixels kept minimum. That is why in the liquid crystal display device 100 of this preferred embodiment, if the luminances of the red, green and blue sub-pixels are increased at the same rate (i.e., one to one to one) with the luminances of the yellow, cyan and magenta sub-pixels kept equal to 0.0, the pixel represents an achromatic color. Likewise, even if the luminances of the yellow, cyan and magenta sub-pixels are increased at the same rate (i.e., one to one to one) with the luminances of the red, green and blue sub-pixels kept equal to 0.0, the pixel also represents an achromatic color.

The following Table 1 shows the respective chromaticity values x and y and Y values, representing the lightness L, of the red sub-pixel (R), green sub-pixel (G), blue sub-pixel (B), yellow sub-pixel (Ye), cyan sub-pixel (C) and magenta sub-pixel (M) in the liquid crystal display device 100 of this preferred embodiment. In this case, if the respective sub-pixels of the liquid crystal display device 100 have the maximum luminance, the color temperature is 6,500 K. It should be noted that in Table 1, x, y and Y are rounded off to the second decimal place.

TABLE 1

| | R | G | B | Ye | C | M |
|---|---|---|---|---|---|---|
| x | 0.65 | 0.28 | 0.14 | 0.47 | 0.15 | 0.33 |
| y | 0.32 | 0.62 | 0.07 | 0.52 | 0.30 | 0.19 |
| Y | 0.10 | 0.29 | 0.04 | 0.28 | 0.18 | 0.12 |

For example, if the liquid crystal display device has color filters, the chromaticity values of the sub-pixels can be finely controlled by adjusting the colors of the color filters.

Also, in a liquid crystal display device with color filters, if the areas of the sub-pixels are equal to each other, the luminance of a pixel in a situation where the luminance of each of the red, green and blue sub-pixels is increased to the maximum value with the luminance of each of the yellow, cyan and magenta sub-pixels kept minimum is lower than that of the pixel in a situation where the luminance of the yellow, cyan and magenta sub-pixels is increased to the maximum value with the luminance of each of the red, green and blue sub-pixels kept minimum. The reason could be simplified as follows. Specifically, a color filter for each of the red, green and blue sub-pixels transmits only incoming light with a wavelength associated with the color of that color filter and cuts off incoming light with any other wavelength. On the other hand, a color filter for each of the yellow, cyan and magenta sub-pixels cuts off incoming light with a wavelength associated with the complementary color of that color filter and transmits incoming light with any other wavelength. That is why the light transmitted through the color filter for the yellow, cyan or magenta sub-pixel should have a higher intensity than the one transmitted through the color filter for the red, green or blue sub-pixel.

Hereinafter, it will be described with reference to FIGS. 3A-3E how the luminances of the red (R), green (G), blue (B), yellow (Ye), cyan (C) and magenta (M) sub-pixels will vary in a situation where the colors represented by a pixel in the liquid crystal display device 100 of this preferred embodiment are changed from black into white while being kept achromatic.

Figure 3A:
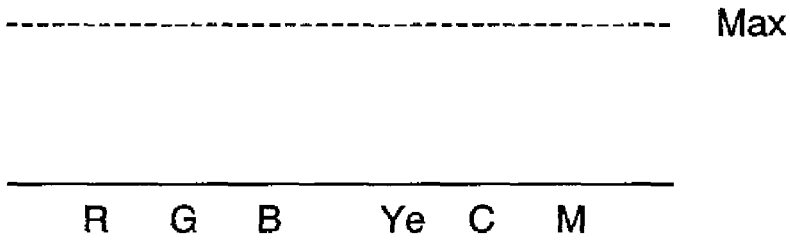
Figure 3B:
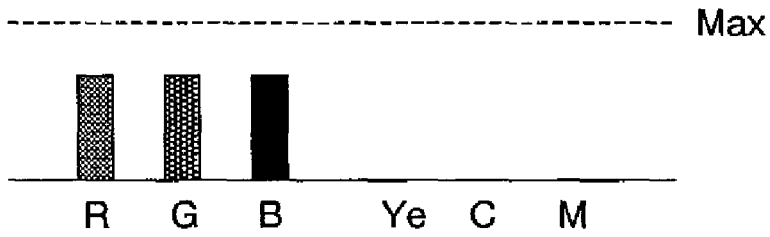

As shown in FIG. 3A, the gray scale levels of the red, green, blue, yellow, cyan and magenta sub-pixels are the lowest at first and the luminance of each of the sub-pixels is 0.0. At this point in time, the color represented by the pixel is black. Next, as shown in FIG. 3B, the luminances of the red, green and blue sub-pixels start to be increased. In this example, the luminances of the red, green and blue sub-pixels are supposed to be increased at the same rate. Meanwhile, the luminance of each of the yellow, cyan and magenta sub-pixels remains 0.0. Since the luminances of the red, green and blue sub-pixels are increased at the same rate, the lightness can be increased without changing the chromaticity values of the pixel (i.e., with the color represented by the pixel kept achromatic).

Figure 3C:
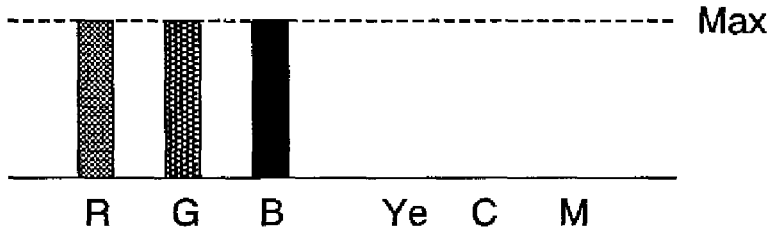

If the luminance of each of the red, green and blue sub-pixels continues to be increased, it will soon reach 1.0 as shown in FIG. 3C. The luminance of the pixel at that point in time will be identified herein by Y1. This luminance value Y1 is obtained by normalizing the luminance value of the pixel in a situation where each of the yellow, cyan and magenta sub-pixels has the minimum luminance and each of the red, green and blue sub-pixels has the maximum luminance with respect to the luminance value of the pixel in a situation where each of all those sub-pixels has the maximum luminance as a unity (=1.0).

Figure 3D:
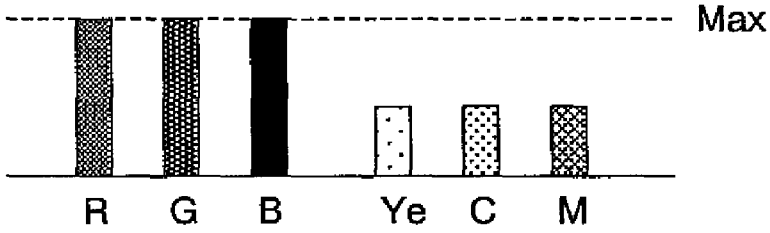
Figure 3E:
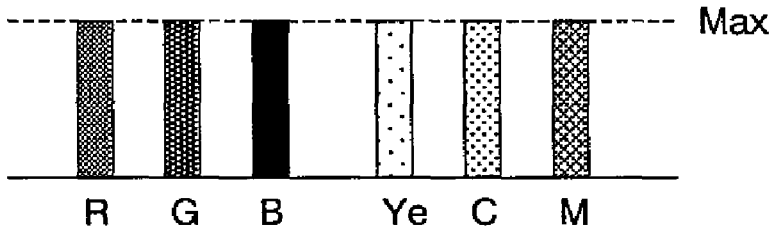

When the luminance of each of the red, green and blue sub-pixels reaches 1.0, the luminance of each of the yellow, cyan and magenta sub-pixels starts to be increased as shown in FIG. 3D. In this example, the luminances of the yellow, cyan and magenta sub-pixels are also supposed to be increased at the same rate. Meanwhile, the luminance of each of the red, green and blue sub-pixels is kept equal to 1.0. Since the luminances of the yellow, cyan and magenta sub-pixels are increased at the same rate, the lightness can be increased without changing the chromaticity values of the pixel. If the luminance of each of the yellow, cyan and magenta sub-pixels continues to be increased, it will soon reach 1.0 as shown in FIG. 3E. At this point in time, the luminance of each of all the sub-pixels becomes equal to 1.0. As a result, white is displayed by the pixel. By changing the luminances of the respective sub-pixels as described above, the colors represented by the pixel change from black into white while being kept achromatic. Conversely, if the luminance of each of all the sub-pixels are initially sets equal to 1.0, the luminances of the yellow, cyan and magenta sub-pixels are decreased at the same rate from 1.0 to 0.0 and then the luminances of the red, green and blue sub-pixels are decreased at the same rate from 1.0 to 0.0, then the colors represented by the pixel change from white into black while being kept achromatic.

In the following description, in a situation where the colors represented by a pixel change from white into black while being kept achromatic, one group of sub-pixels that starts to increase in luminance earlier (i.e., the red, green and blue sub-pixels in this example) will be referred to herein as a "first group of sub-pixels" and the other group of sub-pixels that starts to increase in luminance later (i.e., the yellow, cyan and magenta sub-pixels in this example) will be referred to herein as a "second group of sub-pixels".

Hereinafter, the advantages of the liquid crystal display device of this preferred embodiment over a liquid crystal display device as a comparative example will be described with reference to FIGS. 4 through 6. In the liquid crystal display device as a comparative example, each pixel also includes six sub-pixels, namely, red, green, blue, yellow, cyan and magenta sub-pixels, as in the liquid crystal display device of this preferred embodiment. First, the liquid crystal display device as the comparative example will be described with reference to FIG. 4. As for the liquid crystal display device as the comparative example, it will also be described how the luminances of the respective sub-pixels change in a situation where the colors represented by a pixel are changed from black into white while being kept achromatic.

In the liquid crystal display device as the comparative example, the luminances of all sub-pixels (namely, the red, green, blue, yellow, cyan and magenta sub-pixels) are increased at the same rate as in the conventional liquid crystal display device that has already been described with reference to FIG. 26. As shown in portions (a) and (b) of FIG. 4, when the color represented by the pixel is black, each of all those sub-pixels (i.e., red, green, blue, yellow, cyan and magenta sub-pixels) has a luminance of 0.0. As the luminances of all sub-pixels are increased, the lightness increases and the colors represented by the pixel gradually change from black into gray. If the luminance of each of all the sub-pixels continues to be increased, it will eventually reach 1.0. By continuously increasing the luminance of the pixel in this manner, the colors represented by the pixel change from gray into white. The liquid crystal display device of this comparative example increases the luminances of all sub-pixels at the same rate in this way.

Figure 4:
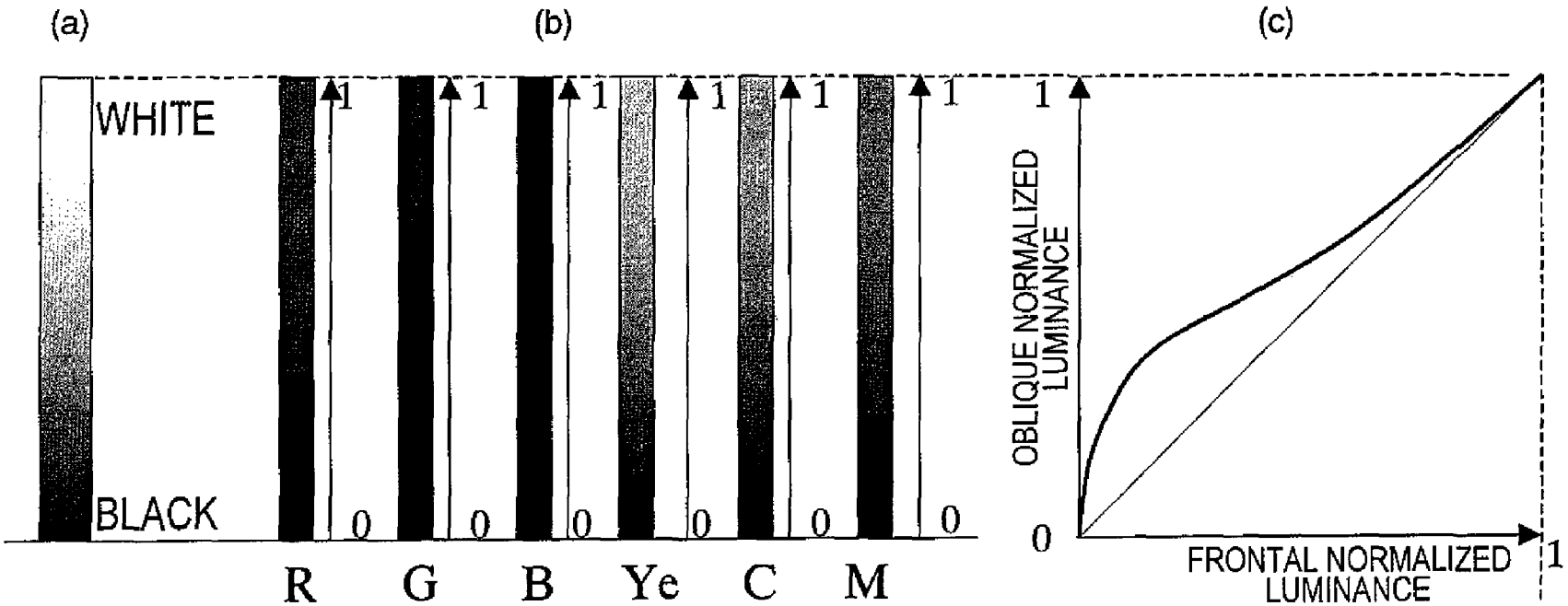
FIG. 4 illustrates how a whitening phenomenon occurs in a liquid crystal display device as a comparative example when the luminances of its sub-pixels are changed, wherein portion (a) of FIG. 4 illustrates how the colors represented by a pixel change, portion (b) of FIG. 4 illustrates how the luminances of the sub-pixels vary, and portion (c) of FIG. 4 is a graph showing a relation between oblique and frontal normalized luminances.

Portion (c) of FIG. 4 is a graph showing how the oblique normalized luminance changes with the frontal normalized luminance in the liquid crystal display device as the comparative example. Hereinafter, it will be described with reference to FIG. 6 what the frontal and oblique normalized luminances mean for a multi-primary-color display panel 200.

Portions (a) through (c) of FIG. 6 are respectively a top view, a front view and a side view of the target multi-primary-color display panel 200. As shown in portions (a) and (c) of FIG. 6, a luminometer 801 is arranged right in front of the measuring point and along a normal to the monitor screen of the panel, while another luminometer 802 is arranged so as to define an angle of rotation of 60 degrees horizontally with respect to the normal to the measuring point on the monitor screen. The frontal luminance is measured by the luminometer 801, while the oblique luminance is measured by the luminometer 802.

The gray scale levels of the pixel at the measuring point are changed from the lowest gray scale level (corresponding to black) into the highest gray scale level (corresponding to white) and the luminance at each of those gray scale levels is measured with the luminometers 801 and 802. After the frontal and oblique luminances at each gray scale level have been measured, frontal and oblique normalized luminances are calculated. In this case, the frontal normalized luminance has been normalized with the frontal luminance at the highest gray scale level supposed to be unity (1.0), while the oblique normalized luminance has been normalized with the oblique luminance at the highest gray scale level supposed to be unity (1.0). That is to say, the frontal normalized luminance is a relative luminance in the frontal viewing direction and the oblique normalized luminance is a relative luminance in the oblique viewing direction.

Look at portion (c) of FIG. 4 again. In the graph shown in portion (c) of FIG. 4, the results obtained for the liquid crystal display device as the comparative example are represented by the bold curve, while an ideal situation where the luminances vary equally both in the frontal and oblique viewing directions is represented by the fine line. As shown in portion (c) of FIG. 4, if the luminances of all sub-pixels are increased at the same rate in the liquid crystal display device as the comparative example, both the oblique and frontal normalized luminances increase but the oblique normalized luminance becomes higher than the frontal one. And until the frontal normalized luminance reaches a predetermined value (e.g., 0.2), the difference between the oblique and frontal normalized luminances continues to increase. But once the frontal normalized luminance exceeds a predetermined value of 0.2, for example, the difference between the oblique and frontal normalized luminances gradually decreases. And when the frontal normalized luminance reaches 1.0, the difference between the oblique and frontal normalized luminances will become zero.

If the oblique normalized luminance (i.e., a relative luminance in the oblique viewing direction) is different from the frontal normalized luminance (i.e., a relative luminance in the frontal viewing direction) at an intermediate luminance in this manner, the display operation will be conducted with the luminances (or gray scale levels) varied differently to two persons' eyes who are looking at the same image on the same liquid crystal display device from the oblique and frontal viewing directions. In general, the luminances (or gray scale levels) are set such that a display operation will be conducted appropriately for a person who is looking from the frontal viewing direction. That is why the display operation cannot be conducted properly for a person who is looking from the oblique viewing direction.

Also, as shown in portion (c) of FIG. 4, the oblique normalized luminance is higher than the frontal normalized luminance at the intermediate luminance. For that reason, for a person who is looking at an image with the intermediate luminance on the screen from an oblique viewing direction, the image will look too whitish. Such a phenomenon that the image on the screen looks too whitish to an oblique viewer's eyes is called a "whitening phenomenon". That whitening phenomenon occurs when a display operation is conducted at the intermediate luminance. The degree of whitening is particularly significant when a display operation is conducted at a low luminance. In other words, the difference between the oblique and frontal normalized luminances is greater at low luminances than at high luminances.

Hereinafter, a liquid crystal display device according to this preferred embodiment will be described with reference to FIG. 5. In the following example, it will also be described how the luminances of respective sub-pixels change in a situation where the colors represented by a pixel are changed from black into white while being kept achromatic.

In the liquid crystal display device of this preferred embodiment, when the color represented by the pixel is black, each of all the sub-pixels (i.e., red, green, blue, yellow, cyan and magenta sub-pixels) has a luminance of 0.0 as shown in portions (a) and (b) of FIG. 5. As already described with reference to FIG. 3, first, each of the red, green and blue sub-pixels (i.e., the first group of sub-pixels) starts to increase in luminance. Meanwhile, the luminance of each of the yellow, cyan and magenta sub-pixels remains 0.0. As the luminance of each of the red, green and blue sub-pixels is increased, the lightness increases and the colors represented by the pixel gradually change from black into gray. If the luminance of each of the red, green and blue sub-pixels is further increased, it will soon reach 1.0, when the pixel will have a luminance Y1.

Next, the luminance of each of the yellow, cyan and magenta sub-pixels (i.e., the second group of sub-pixels) starts to be increased with the luminance of each of the red, green and blue sub-pixels maintained at 1.0. As the luminance of each of the yellow, cyan and magenta sub-pixels continues to be increased, it will soon reach 1.0. And as the luminances are continuously increased in this manner, the colors represented by the pixel gradually change from gray into white. Thus, to change the colors represented by a pixel from black into white while keeping them achromatic, the liquid crystal display device of this preferred embodiment starts to increase the luminances of the red, green and blue sub-pixels first. And when the luminance of each of the red, green and blue sub-pixels reaches 1.0, the device of this preferred embodiment starts to increase the luminances of the yellow, cyan and magenta sub-pixels.

Hereinafter, it will be described with reference to portion (c) of FIG. 5 how the oblique normalized luminance changes with the frontal normalized luminance in the liquid crystal display device of this preferred embodiment. In the graph shown in portion (c) of FIG. 5, the results obtained for the liquid crystal display device of this preferred embodiment are represented by the bold curve, while an ideal situation where the luminances vary equally both in the frontal and oblique viewing directions is represented by the fine line.

In the liquid crystal display device of this preferred embodiment, if the luminances of the red, green and blue sub-pixels are increased at the same rate, both the oblique and frontal normalized luminances also increase. In this case, the oblique normalized luminance becomes higher than the frontal one, thus producing the whitening phenomenon albeit slightly. In the liquid crystal display device of this preferred embodiment, however, once the luminance of each of the red, green and blue sub-pixels exceeds a predetermined value (e.g., 0.2), the closer to 1.0 the luminance of each of the red, green and blue sub-pixels (i.e., the closer to Y1 the luminance of the pixel), the smaller the difference between the oblique and frontal normalized luminances (i.e., the smaller the degree of the whitening phenomenon). And when the luminance of each of the red, green and blue sub-pixels eventually reaches 1.0 (i.e., when the luminance of the pixel becomes equal to Y1), the oblique and frontal normalized luminances will get equal to each other.

Subsequently, the luminance of each of the yellow, cyan and magenta sub-pixels starts to be increased. If the luminances of the yellow, cyan and magenta sub-pixels are increased at the same rate, both the oblique and frontal normalized luminances also increase. In this case, the oblique normalized luminance becomes higher than the frontal one, thus producing the whitening phenomenon albeit slightly. However, once the luminance of each of the yellow, cyan and magenta sub-pixels exceeds a predetermined value (e.g., 0.2), the closer to 1.0 the luminance of each of the yellow, cyan and magenta sub-pixels, the smaller the difference between the oblique and frontal normalized luminances (i.e., the smaller the degree of the whitening phenomenon). And when the luminance of each of the yellow, cyan and magenta sub-pixels eventually reaches 1.0 (i.e., when the luminance of the pixel becomes equal to 1.0), the oblique and frontal normalized luminances will get equal to each other.

As described above, in the liquid crystal display device of this preferred embodiment, when the luminance of each of the red, green and blue sub-pixels is 1.0 while the luminance of each of the yellow, cyan and magenta sub-pixels is 0.0 (i.e., when the luminance of the pixel is equal to Y1), the oblique normalized luminance becomes equal to the frontal one. This is because the whitening phenomenon occurs when the respective sub-pixels have the intermediate luminance, not when the sub-pixels have the maximum or minimum luminance.

In addition, at luminances in the vicinity of Y1, the difference between the oblique and frontal normalized luminances in this preferred embodiment is smaller than that of in the liquid crystal display device as the comparative example shown in portion (c) of FIG. 4. The reason is as follows. Specifically, in the liquid crystal display device as the comparative example shown in portion (c) of FIG. 4, the luminances of all sub-pixels are increased at the same rate. For that reason, the differences between the oblique and frontal normalized luminances of the respective sub-pixels are added together, thus rapidly increasing the degree of the whitening phenomenon. On the other hand, in the liquid crystal display device of this preferred embodiment shown in portion (c) of FIG. 5, the luminances are increased separately in two steps, i.e., for the red, green and blue sub-pixels first and then for the yellow, cyan and magenta sub-pixels. Consequently, the difference between the oblique and frontal normalized luminances does not expand so much as in the comparative example.

As described above, the liquid crystal display device of this preferred embodiment can reduce the difference between the oblique and frontal normalized luminances and can suppress the whitening phenomenon. As a result, even for a person who is looking at the image on the liquid crystal display device of this preferred embodiment from an oblique viewing direction, a display operation can be conducted with the viewing angle dependence of the γ characteristic improved. It should be noted that in the liquid crystal display device of this preferred embodiment, the curve representing a situation where the luminances of the red, green and blue sub-pixels are changed is analogous to the one representing a situation where the luminances of the yellow, cyan and magenta sub-pixels are changed as shown in portion (c) of FIG. 5.

In the example described above, the luminance of each of the yellow, cyan and magenta sub-pixels is supposed to be increased after the luminance of each of the red, green and blue sub-pixels has been increased. However, just to improve the viewing angle dependence of the γ characteristic, the luminance of each of the red, green and blue sub-pixels may be increased after the luminance of each of the yellow, cyan and magenta sub-pixels has been increased. Nevertheless, by starting to increase the luminance of each of the yellow, cyan and magenta sub-pixels after the luminance of each of the red, green and blue sub-pixels has been increased, the following advantages are achieved.

As described above, in the liquid crystal display device 100 of this preferred embodiment, the areas of the respective sub-pixels are equal to each other. That is why the luminance of a pixel in a situation where the luminance of each of the red, green and blue sub-pixels is increased to maximum value thereof with the luminance of each of the yellow, cyan and magenta sub-pixels kept minimum is lower than that of the pixel in a situation where the luminance of each of the yellow, cyan and magenta sub-pixels is increased to their maximum value with the luminance of each of the red, green and blue sub-pixels kept minimum. For that reason, the luminance Y1 of a pixel in a situation where the luminance of each of the red, green and blue sub-pixels is increased to maximum value thereof with the luminance of each of the yellow, cyan and magenta sub-pixels kept minimum is lower than half of that of the pixel in a situation where the luminance of each of all those sub-pixels is increased to maximum value thereof as shown in FIG. 5, and the luminance Y1 is lower than 0.5.

Generally speaking, human vision is relatively insensitive to a luminance variation at high luminances, but is relatively sensitive to a luminance variation at low luminances. For that reason, by minimizing that luminance variation at low luminances (i.e., whitening phenomenon) with the luminance of each of the red, green and blue sub-pixels increased earlier, the influence of that luminance variation on human vision can be suppressed. Also, supposing the respective sub-pixels have the same number of gray scale level (e.g., 256), the number of gray scale levels is 256 both in a range where the pixel has a luminance of 0.0 through Y1 and in a range where the pixel has a luminance of Y1 through 1.0. As mentioned above, human vision is relatively insensitive to a luminance variation at high luminances, but is relatively sensitive to a luminance variation at low luminances. The liquid crystal display device of this preferred embodiment, however, can conduct a display operation with more appropriate luminances when the luminances are low because the number of gray scale levels at low luminances is greater than that of gray scale levels at high luminances.

It should be noted that what has just been described with reference to FIG. 5 is not just about the timing to turn ON sub-pixels (i.e., increase in luminance) in a situation where the colors represented by a pixel are changed from black into white while being kept achromatic. But what has been described with reference to FIG. 5 is nothing but an algorithm for setting the luminances (corresponding to display gray scale levels) of sub-pixels that are associated with the achromatic colors represented by a pixel.

That is to say, in the liquid crystal display device of this preferred embodiment, a combination of luminances for the respective sub-pixels to represent the achromatic colors shown in portion (a) of FIG. 5 is determined based on the algorithm described above. In other words, portion (b) of FIG. 5 shows not just the timing to turn ON (i.e., increase the luminances of) the sub-pixels but also the very combination of luminances for the respective sub-pixels to represent the achromatic colors shown in portion (a) of FIG. 5. For example, to represent the color at the point P shown in portion (a) of FIG. 5, the luminances of the red, green, blue, yellow, cyan and magenta sub-pixels are determined to be (1.0, 1.0, 1.0, 0.5, 0.5, 0.5). The luminances of the respective sub-pixels may be determined in advance based on the algorithm described above or may be generated by calculations.

In the example described above, the red, green, blue, yellow, cyan and magenta sub-pixels are supposed to have the chromaticity values x and y shown in Table 1. However, the liquid crystal display device of the present invention is in no way limited to that specific preferred embodiment.

FIG. 7 is a chromaticity diagram according to the XYZ color system. A spectrum locus and dominant wavelengths are shown in FIG. 7. In this description, a sub-pixel with a dominant wavelength of 605 nm to 635 nm will be referred to herein as a "red sub-pixel", a sub-pixel with a dominant wavelength of 565 nm to 580 nm will be referred to herein as a "yellow sub-pixel", a sub-pixel with a dominant wavelength of 520 nm to 550 nm will be referred to herein as a "green sub-pixel", a sub-pixel with a dominant wavelength of 475 nm to 500 nm will be referred to herein as a "cyan sub-pixel", and a sub-pixel with a dominant wavelength of 470 nm or less will be referred to herein as a "blue sub-pixel".

In the foregoing description, the chromaticity of a pixel in a situation where the luminances of the red, green and blue sub-pixels are increased at the same rate is equal to that of the pixel in a situation where the luminances of the yellow, cyan and magenta sub-pixels are increased at the same rate. Actually, however, the chromaticity of the color represented by the red, green and blue sub-pixels may be slightly different from that of the color represented by the yellow, cyan and magenta sub-pixels. More specifically, even if the differences Δ x and Δ y in chromaticity between the color represented by the red, green and blue sub-pixels and the color represented by the yellow, cyan and magenta sub-pixels are approximately ±0.01, the lightness can still be increased without substantially changing the chromaticity values of the pixel by increasing the luminances of the red, green and blue sub-pixels at the same rate and the luminances of the yellow, cyan and magenta sub-pixels at the same rate.

In the liquid crystal display device 100 of this preferred embodiment (see FIG. 1), the image processor 300 may generate a signal for the multi-primary-color display panel 200

(i.e., the multi-primary-color signal) based on a video signal representing the luminances of the three primary colors. The video signal is a signal adapted to an ordinary three-primary-color liquid crystal display device. To adapt this video signal to the multi-primary-color display panel 200, the image processor 300 converts the video signal into the multi-primary-color signal.

FIG. 8 illustrates a configuration for the liquid crystal display device 100 of this preferred embodiment. In the liquid crystal display device 100 of this preferred embodiment, the image processor 300 preferably includes a signal converter 302 and a multi-primary-color panel driver 304 as shown in FIG. 8.

The signal converter (multi-primary-color converter) 302 receives, as an input signal, a video signal representing the luminances of the three primary colors of red, green and blue, converts the luminances of the three primary colors into those of multiple primary colors (e.g., red, green, blue, yellow, cyan and magenta in this example), and supplies a multi-primary-color signal representing the luminances of the multiple primary colors as an output signal to the multi-primary-color panel driver 304. The multi-primary-color panel driver 304 drives the multi-primary-color display panel 200 based on the multi-primary-color signal supplied from the signal converter 302.

FIG. 9 illustrates a configuration for the signal converter 302. As shown in FIG. 9, the signal converter 302 includes a color component separating section 310 for separating the color specified by the video signal into an achromatic component and chromatic component(s), a chromatic component converting section 312 for converting the chromatic component(s) of the video signal into multi-primary-color components, an achromatic component converting section 314 for converting the achromatic component of the video signal into multi-primary-color components, and a synthesizing section 316 for synthesizing together the multi-primary-color components that have been converted by the chromatic component converting section 312 and the achromatic component converting section 314.

First, a situation where the color specified by the video signal is an achromatic color will be described. In that case, the luminances (or luminance levels) of the three primary colors represented by the video signal are equal to each other. Then, the color component separating section 310 defines the luminance (or luminance level) as achromatic component w. As described above, the color component separating section 310 separates the color specified by the video signal into an achromatic component and chromatic component(s). In this case, however, since the color specified by the video signal is an achromatic color, there are no chromatic components.

The achromatic component converting section 314 converts the achromatic component w into multi-primary-color components, thereby generating a signal with multi-primary-color luminances (r', g', b', ye', c' m') associated with the achromatic component. This conversion is carried out based on the algorithm described above. Specifically, as already described with reference to FIG. 5, the achromatic component w is preferentially allocated to a first group of sub-pixels (which are red, green and blue sub-pixels in this example) and then to a second group of sub-pixels (which are yellow, cyan and magenta sub-pixels in this example).

Next, the synthesizing section 316 clips the luminances (r', g', b', ye', c', m'). If each of the luminances (r', g', b', ye', c', m') exceeds a predetermined range, then the luminances can be clipped to fall within the predetermined range. In this manner, a multi-primary-color signal (R, G, B, Ye, C, M) with multi-primary-color luminances is generated.

In the example described above, the color specified by the video signal is supposed to be an achromatic color (i.e., consist of only an achromatic component). However, the present invention is in no way limited to that specific preferred embodiment. The color specified by the video signal may also be a chromatic color including both achromatic and chromatic components. Hereinafter, such a situation will be described with reference to FIGS. 9 and 10.

Figure 10A:
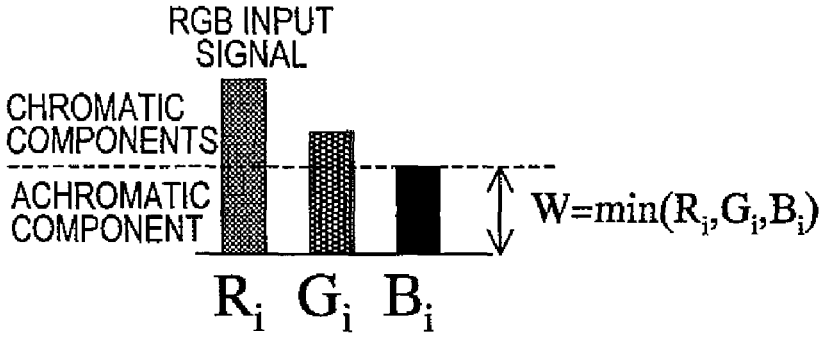

If the color specified by the video signal is a chromatic color including achromatic and chromatic components, the luminances (or luminance levels) of the three primary colors represented by the video signal are not equal to each other. Supposing the luminances of the three primary colors represented by the video signal (or input signal) are Ri, Gi and Bi, the color component separating section 310 determines the lowest luminance (Min (Ri, Gi, Bi)) of the luminances of the three primary colors represented by the video signal and defines it as achromatic component w (i.e., w=Min (Ri, Gi, Bi)) as shown in FIG. 10A, in which w=B. Next, the color component separating section 310 subtracts the achromatic component w from the luminances of the three primary colors, thereby obtaining luminances (Ri-w, Gi-w, Bi-w) associated with chromatic components.

The chromatic component converting section 312 converts the chromatic components (Ri-w, Gi-w, Bi-w) into multi-primary-color components, thereby generating a signal with multi-primary-color luminances (r, g, b, ye, c, m) associated with the chromatic components. Meanwhile, the achromatic component converting section 314 converts the achromatic component w into multi-primary-color components, thereby generating multi-primary-color luminances (r', g', b', ye', c', m') associated with the achromatic component. The conversion is carried out by the achromatic component converting section 314 based on the algorithm described above.

The synthesizing section 316 adds together and clips the luminances (r, g, b, ye, c, m) and the luminances (r', g', b', ye', c', m'), thereby generating a multi-primary-color signal (R, G, B, Ye, C, M) with multi-primary-color luminances. In this manner, the liquid crystal display device 100 of this preferred embodiment can suppress the whitening phenomenon even if the color specified by the video signal includes not only the achromatic component but also chromatic components.

Figure 10B:
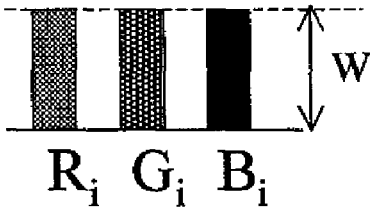
Figure 10C:
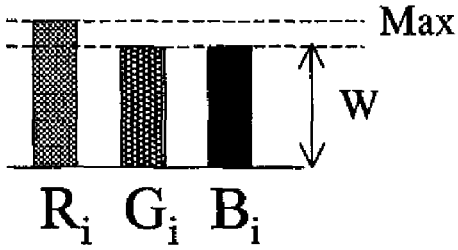
Figure 10D:
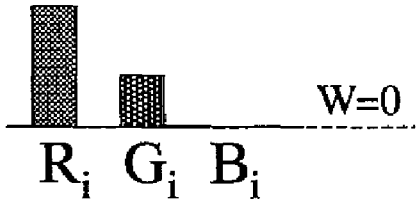

If there is little difference between the minimum and maximum luminances (or luminance levels) represented by the video signal as shown in FIG. 10B (i.e., if the color represented by the video signal is a chromatic color close to an achromatic color), then the achromatic component w accounts for a significant percentage of the maximum luminance of the video signal. On the other hand, FIG. 10C shows the luminances of the three primary colors in a situation where the color specified by the video signal is an achromatic color. In that case, the luminances (or luminance levels) of red, green and blue are equal to each other (i.e., Ri=Gi=Bi) and each of the chromatic component (Ri-w, Gi-w, Bi-w) is equal to zero. Also, if any of the luminances (or luminance levels) of the three primary colors is zero as shown in FIG. 10D, the achromatic component w is also zero (i.e., has the minimum value).

The conversion method adopted by the signal converter 302 described above is just an example, and the multi-primary-color signal may also be generated by any other method. For example, the multi-primary-color signal may also be generated with an RGB three-dimensional lookup table.

Hereinafter, it will be described with reference to FIGS. 11A-11C and 12A-12E what the luminance conversion performed by the liquid crystal display device of this preferred embodiment is like compared to a liquid crystal display device as a comparative example. First, it will be described with reference to FIGS. 11A-11C how the liquid crystal display device as a comparative example changes the luminances (or luminance levels) of the three primary colors represented by the input signal (i.e., a video signal) into those of the multiple primary colors represented by the output signal (i.e., a multi-primary-color signal).

In this example, the luminance (or luminance level) of the input signal is defined with respect to the luminance of a pixel of which each of the red, green and blue sub-pixels has the highest gray scale level. On the other hand, the luminance (or luminance level) of the output signal is defined with respect to the luminance of a pixel of which each of the red, green, blue, yellow, cyan and magenta sub-pixels has the highest gray scale level. In this case, the luminance of the input signal is equal to that of the output signal. If the input signal has a luminance of 0.1 (i.e., if the luminance (or luminance level) of each of the red, green and blue sub-pixels represented by the input signal is equal to 0.1) as shown in FIG. 11A, an output signal indicating that the luminance (or luminance level) of each of all the red, green, blue, yellow, cyan and magenta sub-pixels is equal to 0.1 is generated by converting that input signal.

Likewise, if the input signal has a luminance of 0.3 (i.e., if the luminance of each of the red, green and blue sub-pixels represented by the input signal is equal to 0.3) as shown in FIG. 11B, an output signal indicating that the luminance of each of all the red, green, blue, yellow, cyan and magenta sub-pixels is equal to 0.3 is generated by converting that input signal. In the same way, if the input signal has a luminance of 1.0 as shown in FIG. 11C, an output signal indicating that the luminances of each of all the red, green, blue, yellow, cyan and magenta sub-pixels is equal to 1.0 is generated by converting that input signal. As described above, in the liquid crystal display device of the comparative example, the luminance of each of the red, green, blue, yellow, cyan and magenta sub-pixels changes linearly with the luminance of the input signal.

Next, it will be described with reference to FIGS. 12A-12E how the liquid crystal display device of this preferred embodiment changes the luminances (or luminance levels) represented by the input signal into the ones represented by the output signal. In this example, the color specified by the input signal is supposed to be an achromatic color.

As shown in FIG. 12A, if the input signal has a luminance of 0.1 (i.e., if the luminance of each of the red, green and blue sub-pixels represented by the input signal is 0.1), this luminance of 0.1 is converted by the signal converter 302 (see FIG. 8), thereby generating an output signal indicating that the luminance of each of the red, green and blue sub-pixels is greater than 0.1 and the luminance of each of the yellow, cyan and magenta sub-pixels is equal to 0.0. In that case, the output signal also has a luminance of 0.1.

On the other hand, if the input signal has a luminance of Y1 (i.e., if the luminance of each of the red, green and blue sub-pixels represented by the input signal is Y1) as shown in FIG. 12B, this luminance of Y1 is converted by the signal converter 302, thereby generating an output signal indicating that the luminance of each of the red, green and blue sub-pixels is equal to 1.0 and the luminance of each of the yellow, cyan and magenta sub-pixels is equal to 0.0. In that case, the output signal also has a luminance of Y1.

Furthermore, if the input signal has a luminance of 1.0 as shown in FIG. 12C, this luminance of 1.0 is converted by the signal converter 302, thereby generating an output signal indicating that each of all the red, green, blue, yellow, cyan and magenta sub-pixels has a luminance of 1.0.

The liquid crystal display device of this preferred embodiment changes the modes of luminance change of the respective sub-pixels according to which of the two ranges (i.e., a first range of $0.0 \leqq Y < 1$ and a second range of $Y1 \leqq Y \leqq 1.0$) the luminance Y of the pixel belongs to. In the first range $0.0 \leqq Y \leqq 1$, the luminances of the red, green and blue sub-pixels are changed with the luminance Y of the input signal as shown in FIG. 12D. The maximum change amount of luminance in the first range is Y1. On the other hand, in the second range $Y1 \leqq Y \leqq 1.0$, the luminances of the yellow, cyan and magenta sub-pixels are changed with the luminance Y of the input signal as shown in FIG. 12E. The maximum change amount of luminance in the second range is (1.0-Y1).

If $0.0 \leqq Y \leqq Y1$ is satisfied, these conversions carried out by the signal converter 302 are given by the following equations:

$$R=1.0\times(Y/Y1),$$

$$G=1.0\times(Y/Y1),$$

$$B=1.0\times(Y/Y1),$$

$$Ye=0.0,$$

$$C=0.0 \text{ and}$$

$$M=0.0$$

On the other hand, if $Y1 \leqq Y \leqq 1.0$ is satisfied, then those conversions are given by the following equations:

$$R=1.0,$$

$$G=1.0,$$

$$B=1.0,$$

$$Ye=1.0\times(Y-Y1),$$

$$C=1.0\times(Y-Y1) \text{ and}$$

$$M=1.0\times(Y-Y1)$$

where Y is the luminance of the pixel and R, G, B, Ye, C and M are the luminances of the red, green, blue, yellow, cyan and magenta sub-pixels, respectively.

As described above, the liquid crystal display device of this preferred embodiment changes the luminances of the respective sub-pixels by using a different set of equations according to the luminance of a pixel.

In the example just described, the color specified by the input signal is supposed to be an achromatic color. However, the present invention is in no way limited to that specific preferred embodiment. The color specified by the input signal may also be a chromatic color with an achromatic component. In that case, the upper limit of Y is not 1.0 but the achromatic component w. Also, in that case, the achromatic component converting section 314 makes calculations to replace Y in the equations described above with the achromatic component w, thereby converting the achromatic component w into the color components of the respective sub-pixels (corresponding to r', g', b', ye', c' and m' shown in FIG. 9) as already described with reference to FIG. 9. Meanwhile, the chromatic component converting section 312 converts the chromatic component(s) into the color components of their associated sub-pixels. And the synthesizing section 316 synthesizes together the color components of the respective sub-pixels that have been converted by the chromatic component converting section 312 and the achromatic component converting section 314, thereby generating an output signal.

Next, it will be described with reference to FIG. 13 how the luminances of the sub-pixels change in response to the same video signal that has been input to the liquid crystal display device of this preferred embodiment, which is a multi-primary-color LCD, and to a three-primary-color liquid crystal display device in comparison with each other. As used herein, the "multi-primary-color LCD" refers to a liquid crystal display device that conducts a display operation using four or more primary colors.

As shown in FIG. 13, the same input signal is supplied to the liquid crystal display device 100 of this preferred embodiment and to the three-primary-color liquid crystal display device 500. This input signal may be either an RGB signal or a YCrCb (YCC) signal. The YCrCb signal is usually used in color TV sets and can be converted into an RGB signal. This is an input signal that makes both the multi-primary-color display panel 200 and a display panel 600 conduct a gradation display operation that changes the colors from black into white over the entire screen. By using such an input signal, it can be determined easily whether or not the multi-primary-color liquid crystal display device is a liquid crystal display device according to this preferred embodiment.

As shown in FIG. 13, in the multi-primary-color display panel 200, the red, green, blue, yellow, cyan and magenta sub-pixels have a strip shape and are arranged in stripes in this order. On the other hand, in the display panel 600, the red, green and blue sub-pixels also have a strip shape and are also arranged in stripes in this order.

In the three-primary-color liquid crystal display device 500, a portion K of the display panel 600 displays the color black. In the portion K, every sub-pixel has a luminance of 0.0. In another portion I of the display panel 600, every sub-pixel has a luminance Y1. A portion S of the display panel 600 displays the color white. In the portion S, every sub-pixel has a luminance of 1.0. From the portion K toward the portion S of the display panel 600, the respective sub-pixels have increasing luminances and the pixel has growing lightness.

On the other hand, in the liquid crystal display device 100 of this preferred embodiment, the portion K of the multi-primary-color display panel 200 displays the color black. That is why in the portion K, every sub-pixel has a luminance of 0.0. In another portion I of the multi-primary-color display panel 200, each of the red, green and blue sub-pixels has a luminance of 1.0, whereas each of the yellow, cyan and magenta sub-pixels has a luminance of 0.0. In the intermediate portion between the portions K and I of the multi-primary-color display panel 200, the closer to the portion I from the portion K, the higher the luminance of each of the red, green and blue sub-pixels and the higher the lightness. The portion S of the multi-primary-color display panel 200 displays the color white. In the portion S, every sub-pixel has a luminance of 1.0. As described above, the luminance of 1.0 of each of the sub-pixels refers to the luminance of each of the sub-pixels to represent the color white at a desired color temperature. In the intermediate portion between the portions I and S of the multi-primary-color display panel 200, the closer to the portion S from the portion I, the higher the luminance of each of the yellow, cyan and magenta sub-pixels and the higher the lightness. The luminance of each sub-pixel can be checked by observing the pixels of the multi-primary-color display panel 200 and the display panel 600 during the gradation display in a state of being enlarged by loupe or the like.

In the pixel 210 shown in FIG. 2, the red, green, blue, yellow, cyan and magenta sub-pixels are arranged in this order. However, in the liquid crystal display device of the present invention, the sub-pixels do not have to be arranged in this order. Alternatively, the sub-pixels may also be arranged in a different order from that shown in FIG. 2.

Also, in the example described above, the sub-pixels are arranged in stripes. However, the liquid crystal display device of the present invention is in no way limited to such a specific preferred embodiment. The respective sub-pixels may be arranged in a lattice pattern.

Preferred Embodiment 2

In the preferred embodiment described above, it is not until the luminance of each of the red, green and blue sub-pixels reaches 1.0 that the luminance of each of the yellow, cyan and magenta sub-pixels starts to be increased. However, the present invention is in no way limited to that specific preferred embodiment. Instead, a liquid crystal display device according to this second preferred embodiment of the present invention starts to increase the luminance of each of the yellow, cyan and magenta sub-pixels before the luminance of each of the red, green and blue sub-pixels reaches 1.0.

Hereinafter, a second preferred embodiment of a liquid crystal display device according to the present invention will be described. The liquid crystal display device of this preferred embodiment has substantially the same structure as the counterpart of the first preferred embodiment described above with reference to FIGS. 1, 8 and 9 except that the luminance of each of the yellow, cyan and magenta sub-pixels starts to be increased before the luminance of each of the red, green and blue sub-pixels reaches 1.0. Thus, the repeated description thereof is omitted for avoiding redundancy.

Hereinafter, it will be described with reference to FIG. 14 how the luminances of red, green, blue, yellow, cyan and magenta sub-pixels change in the liquid crystal display device of this preferred embodiment in a situation where the colors represented by a pixel are changed from black into white while being kept achromatic. As shown in portions (a) and (b) of FIG. 14, when the color represented by the pixel is black, each of all the sub-pixels (i.e., red, green, blue, yellow, cyan and magenta sub-pixels) has a luminance of 0.0.

In the liquid crystal display device of this preferred embodiment, first, the luminance of each of the red, green and blue sub-pixels starts to be increased. As the luminance of each of the red, green and blue sub-pixels is increased, the lightness increases and the colors represented by the pixel gradually change from black into gray. As the luminance of each of the red, green and blue sub-pixels is further increased, it will soon reach a predetermined value that is smaller than 1.0 (e.g., 0.9 in this example), when the luminance of each of the yellow, cyan and magenta sub-pixels starts to be increased. When the luminance of each of the red, green and blue sub-pixels reaches the predetermined value, the pixel will have a luminance Y2. As the luminance of each of all the sub-pixels is further increased, the luminance of each of the red, green and blue sub-pixels will soon reach 1.0, when the pixel will have a luminance Y3. After that, the luminance of each of the red, green and blue sub-pixels is maintained at 1.0.

Next, as the luminance of each of the yellow, cyan and magenta sub-pixels continues to be increased, it will soon reach 1.0. When the luminance of each all the sub-pixels (i.e., the red, green, blue, yellow, cyan and magenta sub-pixels) reaches 1.0 in this manner, the colors represented by the pixel change from gray into white. Thus, to change the colors represented by a pixel from black into white while keeping them achromatic, the liquid crystal display device of this preferred embodiment starts to increase the luminance of each of the red, green and blue sub-pixels first. And when the luminance of each of the red, green and blue sub-pixels reaches a predetermined value of less than 1.0, the device of this preferred embodiment starts to increase the luminance of each of the yellow, cyan and magenta sub-pixels.

Hereinafter, it will be described with reference to portion (c) of FIG. 14 how the oblique normalized luminance changes with the frontal normalized luminance in the liquid crystal display device of this preferred embodiment. In the graph shown in portion (c) of FIG. 14, the results obtained for the liquid crystal display device of this preferred embodiment are represented by the bold curve, while an ideal situation where the luminances vary equally both in the frontal and oblique viewing directions is represented by the fine line.

In the liquid crystal display device of this preferred embodiment, if the luminances of the red, green and blue sub-pixels are increased at the same rate, both the oblique and frontal normalized luminances also increase. In this case, the oblique normalized luminance becomes higher than the frontal one, thus producing a whitening phenomenon albeit slightly. In the liquid crystal display device of this preferred embodiment, however, as the luminance of each of the red, green and blue sub-pixels exceeds a predetermined value (e.g., 0.2), the difference between the oblique and frontal normalized luminances (i.e., the degree of the whitening phenomenon) decreases as in the liquid crystal display device of the first preferred embodiment described above. Nevertheless, in the liquid crystal display device of this preferred embodiment, when the luminance of each of the red, green and blue sub-pixels exceeds 0.9, the luminance of each of the yellow, cyan and magenta sub-pixels starts to be increased. That is why the difference between the oblique and frontal normalized luminances becomes equal to the sum of the difference caused by the red, green and blue sub-pixels and the one caused by the yellow, cyan and magenta sub-pixels.

And when the luminance of each of the red, green and blue sub-pixels eventually reaches 1.0, the difference between the oblique and frontal normalized luminances is caused only by the yellow, cyan and magenta sub-pixels. As already described with reference to portion (c) of FIG. 5 for the liquid crystal display device of the first preferred embodiment, once the luminance of each of the yellow, cyan and magenta sub-pixels exceeds a predetermined value (e.g., 0.2), the closer to 1.0 the luminance of each of the yellow, cyan and magenta sub-pixels, the smaller the difference between the oblique and frontal normalized luminances (i.e., the smaller the degree of the whitening phenomenon). And when the luminance of each of the yellow, cyan and magenta sub-pixels eventually reaches 1.0 (i.e., when the luminance of the pixel becomes equal to 1.0), the oblique and frontal normalized luminances will become equal to each other.

In the liquid crystal display device of this preferred embodiment, the high-luminance range of the red, green and blue sub-pixels overlaps with the low-luminance range of the yellow, cyan and magenta sub-pixels. However, where these two ranges do not overlap with each other, the differences between the frontal and oblique normalized luminances are not added together for every sub-pixel. That is why compared to the liquid crystal display device as a comparative example shown in portion (c) of FIG. 4 where the luminances of all sub-pixels are increased at the same rate, the liquid crystal display device of this preferred embodiment can reduce the difference between the frontal and oblique normalized luminances and can suppress the whitening phenomenon.

In the liquid crystal display device of the first preferred embodiment shown in portion (c) of FIG. 5, the closer to Y1 the luminance of the pixel, the smaller the difference between the frontal and oblique normalized luminances. When the luminance of the pixel gets equal to Y1, the difference between the frontal and oblique normalized luminances goes zero. After that, the more the luminance of the pixel increases from Y1, the larger the difference between the frontal and oblique normalized luminances gets again. That is to say, as there is a significant inflection point around the luminance Y1 of the pixel, the luminance change in the vicinity of the luminance Y1 could be insensible to a person who is looking from an oblique viewing direction. In contrast, in the liquid crystal display device of this preferred embodiment, the oblique normalized luminance has a smoothly inflection curve when the oblique normalized luminance falls within the range of approximately Y2 to approximately Y3 as encircled in shown in portion (c) of FIG. 14. Consequently, the luminance change in the vicinity of the luminance Y1 (where Y2<Y1<Y3) is easily sensible to even a person who is looking from an oblique viewing direction. Also, as indicated by the dashed curves in portion (c) of FIG. 14, the curve obtained by changing the luminances of the red, green and blue sub-pixels is analogous to the one obtained by changing the luminances of the yellow, cyan and magenta sub-pixels.

Hereinafter, it will be described with reference to FIGS. 15A-15F how the liquid crystal display device of this preferred embodiment changes the luminances (or luminance levels) represented by the input signal into the ones represented by the output signal. In this example, the luminance (or luminance level) of the input signal is defined by normalizing the luminance of a pixel, of which the red, green and blue sub-pixels have the maximum luminance in a liquid crystal display device that uses the three primary colors, as unity (i.e., 1.0). On the other hand, the luminance (or luminance level) of the output signal is defined by normalizing the luminance of a pixel of which each of the red, green, blue, yellow, cyan and magenta sub-pixels has the maximum luminance, as 1.0. In this case, the color specified by the input signal is also supposed to be an achromatic color.

As shown in FIG. 15A, if the input signal has a luminance of Y2 (where 0.0<Y2<1.0) (i.e., if the luminance of each of the red, green and blue sub-pixels is Y2), this luminance of Y2 is converted by the signal converter 302 (see FIG. 8), thereby generating an output signal indicating that the luminance of each of the red, green and blue sub-pixels is 0.9 and the luminance of each of the yellow, cyan and magenta sub-pixels is 0.0. In that case, the output signal also has a luminance of Y2. On the other hand, if the input signal has a luminance of Y3 (where Y2<Y3<1.0) (i.e., if the luminance of each of the red, green and blue sub-pixels is Y3) as shown in FIG. 15B, this luminance of Y3 is converted by the signal converter 302, thereby generating an output signal indicating that the luminance of each of the red, green and blue sub-pixels is 1.0 and the luminance of each of the yellow, cyan and magenta sub-pixels is 0.1. In that case, the output signal also has a luminance of Y3. Furthermore, if the input signal has a luminance of 1.0 (i.e., if the luminance of each of the red, green and blue sub-pixels is 1.0) as shown in FIG. 15C, this luminance of 1.0 is converted by the signal converter 302, thereby generating an output signal indicating that each of all the red, green, blue, yellow, cyan and magenta sub-pixels has a luminance of 1.0.

The liquid crystal display device of this preferred embodiment changes the modes of luminance change of the respective sub-pixels according to which of the three ranges (i.e., a first range of 0.0≦Y<Y2, a second range of Y2≦<Y3 and a third range of Y3≦Y≦1.0) the luminance Y belongs to. In the first range 0.0≦Y<Y2, the luminances of the red, green and blue sub-pixels are changed with the luminance Y of the input signal as shown in FIG. 15D. The maximum change amount of luminance in the first range is Y2. In the second range Y2≦Y<Y3, the luminances of the red, green, blue, yellow, cyan and magenta sub-pixels are changed with the luminance Y of the input signal as shown in FIG. 15E. The maximum change amount of luminance in the second range is (Y3-Y2). And in the third range Y3≦Y≦1.0, the luminances of the yellow, cyan and magenta sub-pixels are changed with the luminance Y of the input signal as shown in FIG. 15F. The maximum change amount of luminance in the third range is (1.0-Y3).

In the first range (i.e., if 0.0≦Y<Y2 is satisfied), these conversions carried out by the signal converter 302 are given by the following equations:

$$R=0.9\times(Y/Y2),$$

$$G=0.9\times(Y/Y2),$$

$$B=0.9\times(Y/Y2),$$

$$Ye=0.0,$$

$$C=0.0 \text{ and}$$

$$M=0.0$$

On the other hand, in the second range (i.e., if Y2≦Y<Y3 is satisfied), then those conversions are given by the following equations:

$$R=0.1\times(Y-Y2)/(Y3-Y2)+0.9,$$

$$G=0.1\times(Y-Y2)/(Y3-Y2)+0.9,$$

$$B=0.1\times(Y-Y2)/(Y3-Y2)+0.9,$$

$$Ye=0.1\times(Y-Y2)/(Y3-Y2),$$

$$C=0.1\times(Y-Y2)/(Y3-Y2), \text{ and}$$

$$M=0.1\times(Y-Y2)/(Y3-Y2)$$

Furthermore, in the third range (i.e., if Y3≦Y≦1.0 is satisfied), then those conversions are given by the following equations:

$$R=1.0,$$

$$G=1.0,$$

$$B=1.0,$$

$$Ye=0.9\times(Y-Y3)/(1.0-Y3),$$

$$C=0.9\times(Y-Y3)/(1.0-Y3) \text{ and}$$

$$M=0.9\times(Y-Y3)/(1.0-Y3)$$

where Y is the luminance of the pixel and R, G, B, Ye, C and M are the luminances of the red, green, blue, yellow, cyan and magenta sub-pixels, respectively.

As described above, the liquid crystal display device of this preferred embodiment changes the luminances of the respective sub-pixels by using a different set of equations according to the range the luminance of a pixel belongs to.

In the example described above, the predetermined value is supposed to be 0.9. However, the liquid crystal display device of the present invention is in no way limited to that specific preferred embodiment. The liquid crystal display device of the present invention may have a predetermined value of 0.3 to less than 1.0.

Next, it will be described with reference to FIGS. 16A-16F how the luminances of the respective sub-pixels change in a situation where it is not until the luminance of each of the red, green and blue sub-pixels reaches C1 (where 0.3≦C1<1.0) that the luminance of each of the yellow, cyan and magenta sub-pixels starts to be increased. In this case, the color specified by the input signal is also supposed to be an achromatic color.

As shown in FIG. 16A, if the input signal has a luminance of Y2 (where 0.0<Y2<1.0) (i.e., if the luminance of each of the red, green and blue sub-pixels is Y2), this luminance of Y2 is converted by the signal converter 302 (see FIG. 8), thereby generating an output signal indicating that the luminance of each of the red, green and blue sub-pixels is C1 and the luminance of each of the yellow, cyan and magenta sub-pixels is 0.0. In that case, the output signal also has a luminance of Y2. On the other hand, if the input signal has a luminance of Y3 (where Y2<Y3<1.0) (i.e., if the luminance of each of the red, green and blue sub-pixels is Y3) as shown in FIG. 16B, this luminance of Y3 is converted by the signal converter 302, thereby generating an output signal indicating that the luminance of each of the red, green and blue sub-pixels is 1.0 and the luminance of each of the yellow, cyan and magenta sub-pixels is 1.0-C1. In that case, the output signal also has a luminance of Y3. Furthermore, if the input signal has a luminance of 1.0 (i.e., if the luminance of each of the red, green and blue sub-pixels is 1.0) as shown in FIG. 16C, this luminance of 1.0 is converted by the signal converter 302, thereby generating an output signal indicating that each of all the red, green, blue, yellow, cyan and magenta sub-pixels has a luminance of 1.0.

The liquid crystal display device of this preferred embodiment changes the modes of luminance change of the respective sub-pixels according to which of the three ranges (i.e., a first range of 0.0≦Y<Y2, a second range of Y2≦Y<Y3 and a third range of Y3≦Y≦1.0) the luminance Y belongs to. In the first range 0.0≦Y<Y2, the luminances of the red, green and blue sub-pixels are changed with the luminance Y of the input signal as shown in FIG. 16D. The maximum change amount of luminance in the first range is Y2. In the second range Y2≦Y≦Y3, the luminances of the red, green, blue, yellow, cyan and magenta sub-pixels are changed with the luminance Y of the input signal as shown in FIG. 16E. The maximum change amount of luminance in the second range is (Y3-Y2). And in the third range Y3≦Y≦1.0, the luminances of the yellow, cyan and magenta sub-pixels are changed with the luminance Y of the input signal as shown in FIG. 16F. The maximum change amount of luminance in the third range is (1.0-Y3).

In the first range (i.e., if 0.0≦Y<Y2 is satisfied), the luminance of each of the sub-pixels is calculated by:

$$R=C1\times(Y/Y2),$$

$$G=C1\times(Y/Y2),$$

$$B=C1\times(Y/Y2),$$

$$Ye=0.0,$$

$$C=0.0 \text{ and}$$

$$M=0.0$$

In the second range (i.e., if Y2≦Y<Y3 is satisfied), the luminance of each of the sub-pixels is calculated by:

$$R=(1.0-C1)\times(Y-Y2)/(Y3-Y2)+C1,$$

$$G=(1.0-C1)\times(Y-Y2)/(Y3-Y2)+C1,$$

$$B=(1.0-C1)\times(Y-Y2)/(Y3-Y2)+C1,$$

$Ye=(1.0-C1)\times(Y-Y2)/(Y3-Y2)$, $C=(1.0-C1)\times(Y-Y2)/(Y3-Y2)$, and $M=(1.0-C1)\times(Y-Y2)/(Y3-Y2)$ And in the third range (i.e., if $Y3 \leqq Y \leqq 1.0$ is satisfied), the luminance of each of the sub-pixels is calculated by:

$R=1.0$, $G=1.0$, $B=1.0$, $Ye=C1\times(Y-Y3)/(1.0-Y3)$, $C=C1\times(Y-Y3)/(1.0-Y3)$ and $M=C1\times(Y-Y3)/(1.0-Y3)$ where Y is the luminance of the pixel and R, G, B, Ye, C and M are the luminances of the red, green, blue, yellow, cyan and magenta sub-pixels, respectively, and C1 is a predetermined value.

As described above, the liquid crystal display device of this preferred embodiment changes the luminances of the respective sub-pixels by using a different set of equations according to the range the luminance of a pixel belongs to.

In the example described above, the color specified by the input signal is supposed to be an achromatic color. However, the present invention is in no way limited to that specific preferred embodiment. The color specified by the input signal may also be a chromatic color with achromatic component(s).

Also, in the example described above, in the second range $Y2 \leqq Y < Y3$, the luminances of the red, green and blue sub-pixels are supposed to be change at the same rate as the luminances of the yellow, cyan and magenta sub-pixels. However, the present invention is in no way limited to that specific preferred embodiment. In the second range $Y2 \leqq Y < Y3$, the luminances of the red, green and blue sub-pixels may also change at a different rate from the luminances of the yellow, cyan and magenta sub-pixels.

Preferred Embodiment 3

In the preferred embodiments described above, the luminances of the red, green and blue sub-pixels are supposed to be changed at the same rate. However, the present invention is in no way limited to those specific preferred embodiments. The luminances of the red, green and blue sub-pixels may also be changed at mutually different rates.

Hereinafter, a third preferred embodiment of a liquid crystal display device according to the present invention will be described. The liquid crystal display device of this preferred embodiment has substantially the same structure as the counterpart of the first preferred embodiment described above with reference to FIGS. 1, 8 and 9 except that the luminances of the red, green and blue sub-pixels are changed at different rates. Thus, the repeated description thereof is omitted for avoiding redundancy.

The following Table 2 shows the respective chromaticity values x and y and Y values of the red sub-pixel (R), green sub-pixel (G), blue sub-pixel (B), yellow sub-pixel (Ye), cyan sub-pixel (C) and magenta sub-pixel (M) in the liquid crystal display device of this preferred embodiment. In this case, the color temperature is 6,500 K.

TABLE 2

| | R | G | B | Ye | C | M |
|---|---|---|---|---|---|---|
| x | 0.65 | 0.28 | 0.14 | 0.47 | 0.15 | 0.33 |
| y | 0.32 | 0.62 | 0.07 | 0.52 | 0.30 | 0.19 |
| Y | 0.12 | 0.27 | 0.04 | 0.28 | 0.18 | 0.12 |

In the liquid crystal display devices of this preferred embodiments, unlike the liquid crystal display devices of the first and second preferred embodiments described above, the chromaticity values of a pixel when each of the red, green and blue sub-pixels has a luminance of 1.0 are different from those of the pixel when each of the yellow, cyan and magenta sub-pixels has a luminance of 1.0. For example, the chromaticity values x and y of a pixel may be 0.323 and 0.317, respectively, when each of the red, green and blue sub-pixels has a luminance of 1.0 but may be and 0.329, respectively, when each of the yellow, cyan and magenta sub-pixels has a luminance of 1.0.

Thus, the chromaticity values of a pixel when each of the red, green and blue sub-pixels has a luminance of 1.0 are different from those of the pixel when each of the yellow, cyan and magenta sub-pixels has a luminance of 1.0. That is why the chromaticity values of a pixel when each of all the sub-pixels has a luminance of 1.0 are different from those of the pixel when each of the red, green and blue sub-pixels has a luminance of 1.0.

To present the same chromaticity values as those of a pixel when each of all the sub-pixels has a luminance of 1.0 using only the red, green and blue sub-pixels, the liquid crystal display device of this preferred embodiment increases the luminances of the red, green and blue sub-pixels at mutually different rates. For example, by increasing the luminances of the red, green and blue sub-pixels at a ratio of 0.8 to 1.0 to 0.9, the same chromaticity values as those of a pixel when each of all the sub-pixels have a luminance of 1.0 can be presented. Also, in this case, the chromaticity values of a pixel in a situation where the luminances of the red, blue, yellow, cyan and magenta sub-pixels are increased at the ratio of 0.2 to 0.1 to 1.0 to 1.0 to become equal to those of the pixel in a situation where the luminances of the red, green and blue sub-pixels are increased at the ratio of 0.8 to 1.0 to 0.9. Thus, the liquid crystal display device of this preferred embodiment changes the luminances of the red, green and blue sub-pixels at mutually different rates. And an achromatic color is represented by the red, green and blue sub-pixels (that is, the sub-pixels of the first group) and the red, blue, yellow, cyan and magenta sub-pixels (that is, some of the sub-pixels of the first group and all of the sub-pixels of the second group).

Hereinafter, it will be described with reference to FIGS. 17A-17E how the liquid crystal display device of this preferred embodiment changes the luminances (or luminance levels) represented by the input signal into the ones represented by the output signal. In this example, the luminance of the input signal is defined by normalizing the luminance of a pixel, of which each of the red, green and blue sub-pixels has the maximum luminance in a liquid crystal display device that uses the three primary colors, as unity (i.e., 1.0). On the other hand, the luminance of the output signal is defined by normalizing the luminance of a pixel of which each of the red, green, blue, yellow, cyan and magenta sub-pixels has the maximum luminance, as 1.0. In this case, the color specified by the output signal is also supposed to be an achromatic color.

As shown in FIG. 17A, if the input signal has a luminance of Y4 (where $0.0<Y4<1.0$) (i.e., if the luminance of each of the red, green and blue sub-pixels is Y4), this luminance of Y4 is converted by the signal converter 302 (see FIG. 8), thereby generating an output signal indicating that the luminances of the red, green and blue sub-pixels are 0.8, 1.0 and 0.9, respectively, and the luminance of each of the yellow, cyan and magenta sub-pixels is 0.0. In that case, the output signal also has a luminance of Y4. On the other hand, if the input signal has a luminance of Y5 (where Y5=(Y4+1.0)/2) (i.e., if the luminance of each of the red, green and blue sub-pixels is Y5) as shown in FIG. 17B, this luminance of Y5 is converted by the signal converter 302, thereby generating an output signal indicating that the luminances of the red, green and blue sub-pixels are 0.9, 1.0 and 0.95, respectively, and the luminance of each of the yellow, cyan and magenta sub-pixels is 0.5. In that case, the output signal also has a luminance of Y5. Furthermore, if the input signal has a luminance of 1.0 (i.e., if the luminance of each of the red, green and blue sub-pixels is 1.0) as shown in FIG. 17C, this luminance of 1.0 is converted by the signal converter 302, thereby generating an output signal indicating that each of the red, green, blue, yellow, cyan and magenta sub-pixels has a luminance of 1.0.

The liquid crystal display device of this preferred embodiment changes the modes of luminance change of the respective sub-pixels according to which of the two ranges (i.e., a first range of 0.0≦Y<Y4 and a second range of Y4≦Y≦1.0) the luminance Y belongs to. In the first range 0.0≦Y<Y4, the luminances of the red, green and blue sub-pixels are changed with the luminance Y of the input signal as shown in FIG. 17D. In the second range Y4≦Y≦1.0, the luminances of the yellow, cyan and magenta sub-pixels are changed with the luminance Y of the input signal as shown in FIG. 17E. The maximum change amount of luminance in the second range is (1.0-Y4).

In the first range (i.e., if 0.0≦Y<Y4 is satisfied), these conversions carried out by the signal converter 302 are given by the following equations:

$$R=0.8\times(Y/Y4),$$

$$G=1.0\times(Y/Y4),$$

$$B=0.9\times(Y/Y4),$$

$$Ye=0.0,$$

$$C=0.0 \text{ and}$$

$$M=0.0$$

On the other hand, in the second range (i.e., if Y4≦Y≦1.0 is satisfied), those conversions are given by the following equations:

$$R=0.2\times(Y-Y4)/(1.0-Y4)+0.8,$$

$$G=1.0,$$

$$B=0.1\times(Y-Y4)/(1.0-Y4)+0.9,$$

$$Ye=1.0\times(Y-Y4)/(1.0-Y4),$$

$$C=1.0\times(Y-Y4)/(1.0-Y4) \text{ and}$$

$$M=1.0\times(Y-Y4)/(1.0-Y4)$$

In the example just described, it is not until the luminances of the red, green and blue sub-pixels reach 0.8, 1.0 and 0.9, respectively, that the luminance of each of the yellow, cyan and magenta sub-pixel starts to be increased. However, the liquid crystal display device of the present invention is in no way limited to such a specific preferred embodiment. The liquid crystal display device of the present invention may start to increase the luminance of each of the yellow, cyan and magenta sub-pixels after the luminances of the red, green and blue sub-pixels reach respective values other than 0.8, 1.0 and 0.9.

In this example, if the luminances of the red, green and blue sub-pixels when the luminances of the yellow, cyan and magenta sub-pixels starts to be increased are identified by C2, C3 and C4 (where 0.0<C2, C3, C4≦1.0), respectively, the luminance of each of the sub-pixels in the first range (where 0.0≦Y<Y4) may be calculated by:

$$R=C2\times(Y/Y4),$$

$$G=C3\times(Y/Y4),$$

$$B=C4\times(Y/Y4),$$

$$Ye=0.0,$$

$$C=0.0 \text{ and}$$

$$M=0.0$$

In the second range (where Y4≦Y≦1.0), the luminance of each of the sub-pixels is calculated by:

$$R=(1.0-C2)\times(Y-Y4)/(1.0-Y4)+C2,$$

$$G=(1.0-C3)\times(Y-Y4)/(1.0-Y4)+C3,$$

$$B=(1.0-C4)\times(Y-Y4)/(1.0-Y4)+C4,$$

$$Ye=1.0\times(Y-Y4)/(1.0-Y4),$$

$$C=1.0\times(Y-Y4)/(1.0-Y4), \text{ and}$$

$$M=1.0\times(Y-Y4)/(1.0-Y4)$$

where Y is the luminance of the pixel and R, G, B, Ye, C and M are the luminances of the red, green, blue, yellow, cyan and magenta sub-pixels, respectively, and at least one of C2, C3 and C4 is less than 1.0.

As described above, the liquid crystal display device of this preferred embodiment changes the luminances of red, green and blue sub-pixels at different rates, which are determined by the luminance of a pixel represented by an input signal. Also, the device of this preferred embodiment changes the luminance of at least one of the red, green and blue sub-pixels and the luminance of each of the yellow, cyan and magenta sub-pixels according to the luminance of the pixel represented by the input signal.

In the example described above, the rates of increase in the luminances of the red, green and blue sub-pixels in the first range decrease in the order of green, blue and red. However, the liquid crystal display device of the present invention is in no way limited to that specific preferred embodiment. The rates of increase in the luminances of the red, green and blue sub-pixels may also change in any other order.

Also, in the example described above, the color specified by the input signal is supposed to be an achromatic color. However, the present invention is in no way limited to that specific preferred embodiment. The color specified by the input signal may be a chromatic color with an achromatic component.

Preferred Embodiment 4

In the preferred embodiments described above, each pixel has red, green and blue sub-pixels representing the three primary colors of light and yellow, cyan and magenta sub-pixels representing the three primary colors of colors. However, the present invention is in no way limited to those specific preferred embodiments. If necessary, each pixel may have another red sub-pixel instead of a magenta sub-pixel.

Hereinafter, a fourth preferred embodiment of a liquid crystal display device according to the present invention will be described. The liquid crystal display device of this preferred embodiment has substantially the same structure as the counterparts of the first through third preferred embodiments described above except that each pixel has another red sub-pixel instead of a magenta sub-pixel. Thus, the repeated description thereof is omitted for avoiding redundancy. In the following description, the red sub-pixel that contributes along with the green and blue sub-pixels to representing an achromatic color will be referred to herein as a "first red sub-pixel (R1)". On the other hand, the red sub-pixel that contributes along with the yellow and cyan sub-pixels to representing an achromatic color will be referred to herein as a "second red sub-pixel (R2)". Therefore, in this preferred embodiment, the first red, green and blue sub-pixels belong to the first group and the yellow, cyan and second red sub-pixels belong to the second group.

As shown in FIG. 18, in the liquid crystal display device of this preferred embodiment, each pixel 210 includes a first red sub-pixel (R1), a green sub-pixel (G), a blue sub-pixel (B), a yellow sub-pixel (Ye), a cyan sub-pixel (C) and a second red sub-pixel (R2). As disclosed in Japanese Patent Application No. 2005-274510, the liquid crystal display device of this preferred embodiment uses a red sub-pixel instead of a magenta sub-pixel, thereby increasing the lightness of the color red and substantially covering the entire color red range of object color. As a result, a red with high color saturation, i.e., a bright red, can be reproduced.

The following Table 3 shows the respective chromaticity values x and y and Y values of the first red sub-pixel (R1), green sub-pixel (G), blue sub-pixel (B), yellow sub-pixel (Ye), cyan sub-pixel (C) and second red sub-pixel (R2) in the liquid crystal display device of this preferred embodiment. In this case, the liquid crystal display device has a color temperature of 7,000 K.

TABLE 3

| | R1 | G | B | Ye | C | R2 |
|---|---|---|---|---|---|---|
| x | 0.65 | 0.25 | 0.15 | 0.47 | 0.15 | 0.65 |
| y | 0.32 | 0.66 | 0.07 | 0.52 | 0.23 | 0.32 |
| Y | 0.06 | 0.22 | 0.06 | 0.43 | 0.17 | 0.06 |

It should be noted that the chromaticity values x and y of the second red sub-pixel (R2) may or may not be equal to those of the first red sub-pixel (R1). If those two sets of values are the same between the two red sub-pixels, the process of making sub-pixels can be shortened. As for a liquid crystal display device with color filters, for example, the process of making the color filters can be shortened. On the other hand, if the two sets of values are different, then there will be six primary colors represented by the sub-pixels. That is to say, the color reproduction range will be hexagonal on the chromaticity diagram. As a result, the color reproducible range can be expanded particularly in terms of the number of colors that can be represented in the vicinity of the color red.

In the liquid crystal display device of this preferred embodiment, the chromaticity of a pixel in a situation where the luminances of the sub-pixels belonging to the first group are increased at the same rate is preferably substantially equal to the that of the pixel in a situation where the luminances of the sub-pixels belonging to the second group are increased at the same rate as in the counterparts of the first and second preferred embodiments described above. However, the liquid crystal display device of the present invention is in no way limited to that specific preferred embodiment. As in the liquid crystal display device of the third preferred embodiment described above, the chromaticity of a pixel in a situation where the luminances of the sub-pixels belonging to the first group are increased at the same rate may be different from that of the pixel in a situation where the luminances of the sub-pixels belonging to the second group are increased at the same rate, and the luminances of the sub-pixels belonging to the first group may be increased at different rates.

Preferred Embodiment 5

In the preferred embodiments described above, a single pixel includes six sub-pixels. However, the present invention is in no way limited to those specific preferred embodiments. A single pixel may include five sub-pixels.

Hereinafter, a fifth preferred embodiment of a liquid crystal display device according to the present invention will be described. The liquid crystal display device of this preferred embodiment has substantially the same structure as the counterparts of the first through fourth preferred embodiments described above except that each pixel preferably includes five sub-pixels. Thus, the repeated description thereof is omitted for avoiding redundancy.

As shown in FIG. 19, in the liquid crystal display device of this preferred embodiment, each pixel 210 includes not only a red sub-pixel (R), a green sub-pixel (G) and a blue sub-pixel (B) but also two more sub-pixels, namely, a yellow sub-pixel (Ye) and a cyan sub-pixel (C). In this case, the red, green and blue sub-pixels belong to the first group and the yellow and cyan sub-pixels belong to the second group.

The liquid crystal display device of any of the first through fourth preferred embodiments described above includes a cyan sub-pixel that represents a color with an ideal hue. Actually, however, the hue of the cyan sub-pixel may be slightly different from the ideal hue. In the liquid crystal display device of this preferred embodiment, the chromaticity of a pixel in a situation where the luminance of each of the cyan and yellow sub-pixels is increased to the maximum luminance with the luminance of each of the red, green and blue sub-pixels kept minimum is substantially equal to that of the pixel in a situation where the luminance of each of the red, green and blue sub-pixels is increased to the one associated with the highest gray scale level with the luminance of each of the cyan and yellow sub-pixels kept equal to the one associated with the lowest gray scale level.

The following Table 4 shows the respective chromaticity values x and y and Y values of the red sub-pixel (R), green sub-pixel (G), blue sub-pixel (B), yellow sub-pixel (Ye) and cyan sub-pixel (C) in the liquid crystal display device of this preferred embodiment. In this case, the liquid crystal display device has a color temperature of 9,300 K.

TABLE 4

| | R | G | B | Ye | C |
|---|---|---|---|---|---|
| x | 0.65 | 0.26 | 0.14 | 0.47 | 0.15 |
| y | 0.32 | 0.64 | 0.07 | 0.52 | 0.23 |
| Y | 0.10 | 0.30 | 0.05 | 0.40 | 0.15 |

FIG. 20 is a chromaticity diagram that shows the chromaticity values of the respective sub-pixels according to the XYZ color system in the liquid crystal display device of this preferred embodiment. In FIG. 20, (R), (G), (B), (Ye) and (C) indicate the chromaticity values of the red, green, blue, yellow, and cyan sub-pixels, respectively. The chromaticity values of a color to be represented when each of the red (R), green (G) and blue (B) sub-pixels has the maximum luminance is approximately equal to the quotient obtained by dividing the sum of the chromaticity values x of the red (R), green (G) and blue (B) sub-pixels by three and the quotient obtained by dividing the sum of the chromaticity values y of the red (R), green (G) and blue (B) sub-pixels by three according to XYZ color system, respectively. Consequently, the chromaticity values x and y of the pixel in a situation where the luminances of the red (R), green (G) and blue (B) sub-pixels are increased at the same rate are 0.33 and 0.35, respectively.

Meanwhile, in the liquid crystal display device of this preferred embodiment, the chromaticity values of the cyan sub-pixel are different from those of the cyan sub-pixel in the liquid crystal display device of the first preferred embodiment described above. The chromaticity values of the pixel in a situation where the luminance of each of the yellow (Ye) and cyan (C) sub-pixels is increased to the maximum one are approximately equal to the quotients obtained by dividing the sum of the chromaticity values x and the sum of the chromaticity values y of the yellow (Ye) and cyan (C) sub-pixels by two on the chromaticity diagram according to the XYZ color system. That is why the chromaticity of the pixel in a situation where the luminance of each of the yellow (Ye) and cyan (C) sub-pixels is increased to the maximum one becomes approximately equal to that of the pixel in a situation where the luminance of each of the red (R), green (G) and blue (B) sub-pixels is increased to the maximum one. Consequently, by driving the liquid crystal display device of this preferred embodiment just like the counterparts of the first through fourth preferred embodiments described above, a color reproduction range that is wider than that of a normal liquid crystal display device that uses the three primary colors is realized and the whitening phenomenon can be suppressed as well.

As shown in FIG. 21A, if the input signal has a luminance of 0.1 (i.e., if the luminance of each of the red, green and blue sub-pixels represented by the input signal is 0.1), for example, then this luminance value of 0.1 is converted by the signal converter 302 shown in FIG. 8. As a result, an output signal indicating that the luminance of each of the red, green and blue sub-pixels is greater than 0.1 and the luminance of each of the yellow and cyan sub-pixels is 0.0 is generated. In this case, the output signal also has a luminance of 0.1. On the other hand, if the input signal has a luminance of Y1 (i.e., if the luminance of each of the red, green and blue sub-pixels represented by the input signal is Y1), for example, then this luminance value of Y1 is converted by the signal converter 302. As a result, an output signal indicating that the luminance of each of the red, green and blue sub-pixels is 1.0 and the luminance of each of the yellow and cyan sub-pixels is 0.0 is generated as shown in FIG. 21B. In this case, the output signal also has a luminance of Y1. Furthermore, if the input signal has a luminance of 1.0, then this luminance of 1.0 is converted by the signal converter 302, thereby generating an output signal indicating that each of the red, green, blue, yellow, and cyan sub-pixels has a luminance of 1.0 as shown in FIG. 21C.

The liquid crystal display device of this preferred embodiment changes the modes of luminance change of the respective sub-pixels according to which of the two ranges (i.e., a first range of $0.0 \leqq Y < Y1$ and a second range of $Y1 \leqq Y \leqq 1.0$) the luminance Y belongs to. In the first range $0.0 \leqq Y < Y1$, the luminances of the red, green and blue sub-pixels are changed with the luminance Y of the input signal as shown in FIG. 21D. The maximum change amount of luminance in the first range is Y1. On the other hand, in the second range $Y1 \leqq Y \leqq 1.0$, the luminances of the yellow and cyan sub-pixels are changed with the luminance Y of the input signal as shown in FIG. 21E. The maximum change amount of luminance in the second range is (1.0-Y1).

In the liquid crystal display device of this preferred embodiment, the chromaticity of a pixel in a situation where the luminances of the sub-pixels belonging to the first group are increased at the same rate is preferably substantially equal to that of the pixel in a situation where the luminances of the sub-pixels belonging to the second group are increased at the same rate as in the counterparts of the first and second preferred embodiments described above. However, the liquid crystal display device of the present invention is in no way limited to that specific preferred embodiment. As in the liquid crystal display device of the third preferred embodiment described above, the chromaticity of a pixel in a situation where the luminances of the sub-pixels belonging to the first group are increased at the same rate may be different from that of the pixel in a situation where the luminances of the sub-pixels belonging to the second group are increased at the same rate, and the luminances of the sub-pixels belonging to the first group may be increased at different rates.

Preferred Embodiment 6

In the preferred embodiments described above, a single pixel includes five or more sub-pixels. However, the present invention is in no way limited to those specific preferred embodiments. A single pixel may consist of four sub-pixels.

Hereinafter, a sixth preferred embodiment of a liquid crystal display device according to the present invention will be described. The liquid crystal display device of this preferred embodiment has substantially the same structure as the counterparts of the first through fifth preferred embodiments described above except that each pixel includes four sub-pixels. Thus, the repeated description thereof is omitted for avoiding redundancy.

As shown in FIG. 22, in the liquid crystal display device of this preferred embodiment, each pixel 210 includes not only a red sub-pixel (R), a green sub-pixel (G) and a blue sub-pixel (B) but also one more sub-pixel, which will be referred to herein as a "white sub-pixel (W)". In this case, the red, green and blue sub-pixels belong to the first group and the white sub-pixel belongs to the second group.

The following Table 5 shows the respective chromaticity values x and y and Y values of the red sub-pixel (R), green sub-pixel (G), blue sub-pixel (B) and white sub-pixel (W) in the liquid crystal display device of this preferred embodiment. In this case, the liquid crystal display device has a color temperature of 6,500 K.

TABLE 5

| | R | G | B | W |
|---|---|---|---|---|
| x | 0.64 | 0.31 | 0.15 | 0.31 |
| y | 0.34 | 0.56 | 0.07 | 0.33 |
| Y | 0.10 | 0.32 | 0.04 | 0.55 |

Consequently, by driving the liquid crystal display device of this preferred embodiment just like the counterparts of the first through fifth preferred embodiments described above, higher lightness will be achieved compared to the normal three-primary-color liquid crystal display device and the whitening phenomenon can be suppressed as well.

As shown in FIG. 23A, if the input signal has a luminance of 0.1 (i.e., if the luminance of each of the red, green and blue sub-pixels represented by the input signal is 0.1), for example, then this luminance value of 0.1 is converted by the signal converter 302 shown in FIG. 8. As a result, an output signal indicating that the luminance of each of the red, green and blue sub-pixels is greater than 0.1 and the luminance of each of the white sub-pixel is 0.0 is generated. In this case, the output signal also has a luminance of 0.1. On the other hand, if the input signal has a luminance of Y1 (i.e., if the luminance of each of the red, green and blue sub-pixels represented by the input signal is Y1), for example, then an output signal indicating that the luminance of each of the red, green and blue sub-pixels is 1.0 and the luminance of each of the white sub-pixel is 0.0 is generated as shown in FIG. 23B. In this case, the output signal also has a luminance of Y1. Furthermore, if the input signal has a luminance of 1.0, then this luminance of 1.0 is converted by the signal converter 302, thereby generating an output signal indicating that each of the red, green, blue, and white sub-pixels has a luminance of 1.0 as shown in FIG. 23C.

The liquid crystal display device of this preferred embodiment changes the modes of luminance change of the respective sub-pixels according to which of the two ranges (i.e., a first range of $0.0 \leqq Y < Y1$ and a second range of $Y1 \leqq Y \leqq 1.0$) the luminance Y belongs to. In the first range $0.0 \leqq Y < Y1$, the luminances of the red, green and blue sub-pixels are changed with the luminance Y of the input signal as shown in FIG. 23D. The maximum change amount of luminance in the first range is Y1. On the other hand, in the second range $Y1 \leqq Y \leqq 1.0$, the luminance of the white sub-pixel are changed with the luminance Y of the input signal as shown in FIG. 23E. The maximum change amount of luminance in the second range is (1.0-Y1).

In the liquid crystal display device of this preferred embodiment, the chromaticity of a pixel in a situation where the luminances of the sub-pixels belonging to the first group are increased at the same rate is preferably substantially equal to that of the pixel in a situation where the luminances of the sub-pixel belonging to the second group are increased at the same rate as in the counterparts of the first and second preferred embodiments described above. However, the liquid crystal display device of the present invention is in no way limited to that specific preferred embodiment. As in the liquid crystal display device of the third preferred embodiment described above, the chromaticity of a pixel in a situation where the luminances of the sub-pixels belonging to the first group are increased at the same rate may be different from that of the pixel in a situation where the luminances of the sub-pixel belonging to the second group are increased at the same rate, and the luminances of the sub-pixels belonging to the first group may be increased at different rates.

Preferred Embodiment 7

In the preferred embodiments described above, in a situation where the colors represented by a pixel change from black into white, it is not until the luminance of each of the red, green and blue sub-pixels starts to be increased that the luminance of each of the other sub-pixels (such as yellow, cyan and magenta sub-pixels) starts to be increased. However, the present invention is in no way limited to those specific preferred embodiments. The luminance of each of the red, green and blue sub-pixels may start to be increased after the luminance of each of the other sub-pixel(s) has started to be increased.

Hereinafter, a seventh preferred embodiment of a liquid crystal display device according to the present invention will be described. The liquid crystal display device of this preferred embodiment has substantially the same structure as the counterpart of the first preferred embodiment described above except that the area of the yellow, cyan and magenta sub-pixels is smaller than that of the red, green and blue sub-pixels. Thus, the repeated description thereof is omitted for avoiding redundancy.

In the liquid crystal display device of this preferred embodiment, the area of the yellow, cyan and magenta sub-pixels is smaller than that of the red, green and blue sub-pixels as shown in FIG. 24. For example, the ratio of the area of the yellow, cyan and magenta sub-pixels to that of the red, green and blue sub-pixels may be one to three.

In the liquid crystal display device of this preferred embodiment, the yellow, cyan and magenta sub-pixels have the smaller area. That is why the luminance of a pixel in a situation where the luminance of each of the yellow, cyan and magenta sub-pixels is increased to a value associated with the highest gray scale level is smaller than that of the pixel in a situation where the luminance of each of the red, green and blue sub-pixels is increased to a value associated with the highest gray scale level.

In the liquid crystal display device of the first preferred embodiment that has already been described with reference to portion (c) of FIG. 5, the luminance of a pixel in a situation where the luminance of each of the red, green and blue sub-pixels is increased to a value associated with the highest gray scale level is smaller than that of the pixel in a situation where the luminance of each of the yellow, cyan and magenta sub-pixels is increased to a value associated with the highest gray scale level. That is why the luminance of each of the red, green and blue sub-pixels starts to be increased earlier than the yellow, cyan and magenta sub-pixels. On the other hand, in the liquid crystal display device of this preferred embodiment, the luminance of a pixel in a situation where the luminance of each of the yellow, cyan and magenta sub-pixels is increased to a value associated with the highest gray scale level is smaller than that of the pixel in a situation where the luminance of each of the red, green and blue sub-pixels is increased to a value associated with the highest gray scale level. That is why the luminance of each of the yellow, cyan and magenta sub-pixels starts to be increased earlier than the luminance of each of the red, green and blue sub-pixels. For that reason, in changing the colors represented by a pixel from black into white while keeping them achromatic, the first group of sub-pixels that starts to increase in luminance earlier includes the yellow, cyan and magenta sub-pixels, and the second group of sub-pixels that starts to increase in luminance later includes the red, green and blue sub-pixels. Even so, a display operation can be conducted more appropriately at relatively low luminances.

In the liquid crystal display device of this preferred embodiment, when the color represented by the pixel is black, each of all those sub-pixels (namely, red, green, blue, yellow, cyan and magenta sub-pixels) has a luminance of 0.0 as shown in portions (a) and (b) of FIG. 25. In the liquid crystal display device of this preferred embodiment, the luminance of each of the yellow, cyan and magenta sub-pixels starts to be increased first. Meanwhile, the luminance of each of the red, green and blue sub-pixels remains 0.0 at this time. As the luminance of each of the yellow, cyan and magenta sub-pixels is increased more, the lightness increases and the colors represented by the pixel gradually change from black into gray.

If the luminance of each of the yellow, cyan and magenta sub-pixels is further increased, it will soon reach 1.0, when the pixel will have a luminance Y1. Next, the luminance of each of the red, green and blue sub-pixels starts to be increased with the luminance of each of the yellow, cyan and magenta sub-pixels maintained at 1.0. As the luminance of each of the red, green and blue sub-pixels continues to be increased, it will soon reach 1.0. And as the luminances are continuously increased in this manner, the colors represented by the pixel gradually change from gray into white. Thus, to change the colors represented by a pixel from black into white while keeping them achromatic, the liquid crystal display device of this preferred embodiment starts to increase the luminance of each of the yellow, cyan and magenta sub-pixels first. And when the luminance of each of the yellow, cyan and magenta sub-pixels reaches 1.0, the device of this preferred embodiment starts to increase the luminances of the red, green and blue sub-pixels.

The liquid crystal display device of this preferred embodiment can also reduce the difference between the oblique and frontal normalized luminances as shown in portion (c) of FIG. 25 and can suppress the whitening phenomenon. As a result, even for a person who is looking at the image on the liquid crystal display device of this preferred embodiment from an oblique viewing direction, a display operation can be conducted with the viewing angle dependence of the γ characteristic improved.

In the preferred embodiment just described, the first group of sub-pixels includes yellow, cyan and magenta sub-pixels. However, the present invention is in no way limited to that specific preferred embodiment. The first group of sub-pixels may consist of yellow, cyan and second red sub-pixels (Ye, C, R2) as shown in FIG. 18. Alternatively, the first group of sub-pixels may consist of yellow and cyan sub-pixels (Ye, C) as shown in FIG. 19. Still alternatively, the first group of sub-pixels may even consist of a white sub-pixel (W) only as shown in FIG. 22.

In the liquid crystal display device of any of the first through seventh preferred embodiments described above, sub-pixels belonging to one of the two groups are preferably red, green and blue sub-pixels. However, the present invention is in no way limited to those specific preferred embodiments. The sub-pixels belonging to one of the two groups may also be red, green and cyan sub-pixels, while the sub-pixels belonging to the other group may also be yellow, magenta and blue sub-pixels. Alternatively, the sub-pixels belonging to the other group may be yellow and blue sub-pixels alone.

In the liquid crystal display devices of the first through seventh preferred embodiments described above, an MVA mode LCD panel is used as an exemplary multi-primary-color display panel. However, the liquid crystal display device of the present invention does not have to use that multi-primary-color display panel. The display panel may also be an LCD panel operating in any other mode such as an ASM mode LCD panel, or an IPS mode LCD panel. Nevertheless, the viewing angle dependence of the γ characteristic is more significant in MVA and ASM mode LCD panels than in an IPS mode LCD panel. For that reason, the present invention is preferably applied to a situation where an MVA mode or ASM mode LCD panel needs to be used.

Also, the liquid crystal display devices of the first through seventh preferred embodiments described above reproduce colors using color filters. However, the liquid crystal display device of the present invention is in no way limited to those specific preferred embodiments. The colors may also be represented by driving the device of the present invention by a field sequential technique. According to the field sequential technique, a color display operation is conducted by forming a single frame of multiple subframes associated with a number of primary colors that include at least one primary color belonging to a first group and at least one primary color belonging to a second group, and the primary color of the second group is different from that of the first group. For example, the first group of primary colors may be red, green and blue and the second group of primary colors may be yellow, cyan and magenta. In that case, if the colors represented by a pixel change from black into white while being kept achromatic, the luminance of the pixel may be increased first in the subframes associated with the first group of primary colors as shown in FIGS. 5 and 25. And once the luminance of the pixel reaches a predetermined value in the subframes associated with the first group of primary colors, the luminance of the pixel starts to be increased in the subframes associated with the second group of primary colors. In this manner, even a liquid crystal display device that adopts the field sequential technique can achieve the same effects.

Various preferred embodiments of the present invention provide a liquid crystal display device that can conduct a display operation in a wide color reproduction range with the whitening phenomenon suppressed. The present invention is particularly effectively applicable to a liquid crystal display device with an MVA or ASM mode LCD panel, among other things.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A liquid crystal display device comprising:

a pixel including at least four sub-pixels; wherein the sub-pixels include at least one sub-pixel belonging to a first group and at least one sub-pixel belonging to a second group, the sub-pixel of the second group being different from that of the first group; and luminances of the sub-pixels are set such that if the colors represented by the pixel change from black into white while being kept achromatic, the first group of sub-pixel starts to increase in luminance first, and the second group of sub-pixel starts to increase in luminance when the luminance of the first group of sub-pixel reaches a predetermined value.

2. The liquid crystal display device of claim 1, wherein an area occupied by the sub-pixel in the first group is equal to that of the sub-pixel in the second group.

3. The liquid crystal display device of claim 1, wherein an area occupied by the sub-pixel in the first group is smaller than that of the sub-pixel in the second group.

4. The liquid crystal display device of claim 1, wherein achromatic colors are represented by each of the sub-pixel belonging to the first group and the sub-pixel the second group.

5. The liquid crystal display device of claim 1, wherein the chromaticity of the pixel in a situation where the luminance of the first group of sub-pixel is increased with that of the second group of sub-pixel kept equal to a value associated with the lowest gray scale level is equal to that of the pixel in a situation where each of all the sub-pixels has a luminance associated with the highest gray scale level.

6. The liquid crystal display device of claim 1, wherein the luminance of the pixel in a situation where the luminance of the first group of sub-pixel is increased to a value associated with the highest gray scale level with that of the second group of sub-pixel kept equal to a value associated with the lowest gray scale level is lower than that of the pixel in a situation where the luminance of the second group of sub-pixel is increased to the value associated with the highest gray scale level with that of the first group of sub-pixel kept equal to the value associated with the lowest gray scale level.

7. The liquid crystal display device of claim 1, wherein the first group of sub-pixel includes multiple sub-pixels, and in every sub-pixel in the first group, a ratio of the predetermined luminance to a luminance associated with the highest gray scale level is the same.

8. The liquid crystal display device of claim 1, wherein the predetermined luminance is a luminance of the first group of sub-pixel that is associated with the highest gray scale level.

9. The liquid crystal display device of claim 1, wherein the predetermined luminance is lower than a luminance of the first group of sub-pixel that is associated with the highest gray scale level.

10. The liquid crystal display device of claim 1, wherein the first group of sub-pixel includes multiple sub-pixels, and the luminances of the sub-pixels are set such that in a situation where the colors represented by the pixel change from black into white while being kept achromatic, when the luminance of the sub-pixels in the first group reaches the predetermined value, the second group of sub-pixel starts to increase in luminance and at least one of the sub-pixels in the first group continues to increase in luminance.

11. The liquid crystal display device of claim 10, wherein the predetermined luminance is at least about 0.3 times as large as, but still not more than, the luminance associated with the highest gray scale level.

12. The liquid crystal display device of claim 11, wherein the predetermined luminance is about 0.9 times as large as the luminance associated with the highest gray scale level.

13. The liquid crystal display device of claim 10, wherein the first group of sub-pixel includes multiple sub-pixels, and a ratio of the predetermined luminance to the luminance associated with the highest gray scale level is different from each other in each of the sub-pixels in the first group.

14. The liquid crystal display device of claim 1, wherein the first group of sub-pixel includes red, green and blue sub-pixels.

15. The liquid crystal display device of claim 14, wherein the second group of sub-pixel includes yellow, cyan and magenta sub-pixels.

16. The liquid crystal display device of claim 14, wherein the second group of sub-pixel includes yellow and cyan sub-pixels and another red sub-pixel, which is different from the red sub-pixel.

17. The liquid crystal display device of claim 14, wherein the second group of sub-pixel includes a white sub-pixel.

18. The liquid crystal display device of claim 14, wherein the second group of sub-pixel includes yellow and cyan sub-pixels.

19. The liquid crystal display device of claim 1, wherein the first group of sub-pixel includes yellow, cyan and magenta sub-pixels, and the second group of sub-pixel includes red, green and blue sub-pixels.

20. A liquid crystal display device comprising:

a pixel that represents a color by using at least four primary colors in an arbitrary combination at an arbitrary luminance; wherein the primary colors include at least one primary color belonging to a first group and at least one primary color belonging to a second group, the primary color of the second group being different from that of the first group; and luminances of the primary colors are set such that if the colors represented by the pixel change from black into white while being kept achromatic, the first group of primary color starts to increase in luminance first, and the second group of primary color starts to increase in luminance when the luminance of the first group of primary color reaches a predetermined value.

21. A liquid crystal display device comprising:

a pixel including at least four sub-pixels; wherein the sub-pixels include at least one sub-pixel belonging to a first group and at least one sub-pixel belonging to a second group, the sub-pixel of the second group being different from that of the first group;

the sub-pixels represent a color including a chromatic component and an achromatic component; and luminances of the sub-pixels, which are associated with the achromatic component, are set such that if the achromatic component change from a minimum value into a maximum value, the first group of sub-pixel starts to increase in luminance first, and the second group of sub-pixel starts to increase in luminance when the luminance of the first group of sub-pixel reaches a predetermined value.

22. A signal converter for generating a multi-primary-color signal, representing the luminances of multiple primary colors, based on a video signal for use in a multi-primary-color display panel that conducts a display operation in at least four primary colors, including at least one primary color belonging to a first group and at least one primary color belonging to a second group, the primary color of the second group being different from that of the first group, the signal converter comprising:

a color component separating section arranged to separate a color specified by the video signal into an achromatic component and a chromatic component;

an achromatic component converting section arranged to convert the achromatic component of the video signal into color components of the multiple primary colors;

a chromatic component converting section arranged to convert the chromatic component of the video signal into color components of the multiple primary colors; and a synthesizing section arranged to synthesize together the color components of the multiple primary colors that have been converted by the achromatic and chromatic component converting sections, thereby generating the multi-primary-color signal; wherein if the achromatic component changes from a minimum value to a maximum value, the achromatic component converting section starts to increase the luminance of the first group of primary colors first, and starts to increase the luminance of the second group of primary colors when the luminance of the first group of primary colors reaches a predetermined value.

* * * * *